US005967687A

United States Patent [19]

Oike

[11] Patent Number: 5,967,687

[45] Date of Patent: Oct. 19, 1999

[54] DIRECT LIQUID SUPPLY WRITING IMPLEMENT

[75] Inventor: Shigeru Oike, Aichi, Japan

[73] Assignee: The Pilot Ink Co., Ltd., Aichi, Japan

[21] Appl. No.: 09/141,560

[22] Filed: Aug. 28, 1998

[30] Foreign Application Priority Data

| | | | |
|---|---|---|---|
| Aug. 29, 1997 | [JP] | Japan | 9-249937 |
| Apr. 23, 1998 | [JP] | Japan | 10-131375 |
| Jun. 26, 1998 | [JP] | Japan | 10-196602 |
| Jul. 17, 1998 | [JP] | Japan | 10-219810 |

[51] Int. Cl.[6] ..... B43K 5/02; B43K 5/18

[52] U.S. Cl. ..... 401/198; 401/151; 401/199

[58] Field of Search ..... 401/198, 199, 401/151

[56] References Cited

U.S. PATENT DOCUMENTS

| | | | |
|---|---|---|---|
| 3,113,336 | 12/1963 | Langnickel | 401/199 X |
| 5,026,189 | 6/1991 | Keil | 401/198 X |

FOREIGN PATENT DOCUMENTS

| | | | |
|---|---|---|---|
| 0 803 381 | 10/1997 | European Pat. Off. . | |
| 195 29 865 | 2/1997 | Germany . | |
| 422575 | 4/1967 | Switzerland | 401/198 |
| 1120746 | 7/1968 | United Kingdom | 401/198 |
| WO 98/21052 | 5/1998 | WIPO . | |

OTHER PUBLICATIONS

Patent Abstracts of Japan, vol. 098, No. 011 Sep. 30, 1998, & JP 10 166781 A (Zebra Pen Corp) Jun. 23 1998, *Abstract.

*Primary Examiner*—David J. Walczak
*Assistant Examiner*—Kathleen J. Prunner
*Attorney, Agent, or Firm*—Sughrue, Mion, Zinn, Macpeak & Seas, PLLC

[57] ABSTRACT

A direct ink supply writing implement according to the present invention is provided with an ink reservoir made of a porous material disposed between a nib and an ink tank; a partition wall disposed between the ink reservoir and the ink tank and arranged to partition the ink reservoir and the ink tank from each other; a communication hole formed in the partition wall for establishing communication between the ink reservoir and the ink tank; a rod-shape ink guiding member which penetrates the partition wall and with which ink is supplied from the ink tank to the nib; and a compressed portion formed at a rear end of the ink reservoir and arranged to enhance capillary force as compared with other portions.

16 Claims, 17 Drawing Sheets

DIRECT LIQUID SUPPLY WRITING IMPLEMENT

BACKGROUND OF THE INVENTION

1. Field of the Invention

The present invention relates to a direct ink supply writing implement. More particularly, the present invention relates to a direct ink supply writing implement arranged to directly accumulate ink in an ink tank and having an ink reservoir made of a porous material and disposed between a nib and the ink tank so that ink discharged when the pressure in the ink tank has been raised is temporarily stored in the ink reservoir. In the present invention, note that the expression "front" means a portion adjacent to the nib and the expression "rear" means a portion adjacent to the ink tank.

2. Description of the Related Art (a) Examined Japanese Utility-Model Publication No. 56-33739

In the publication (a), an implement for writing has been disclosed which incorporates a nib secured to the leading end of a barrel. Moreover, an ink reservoir disposed in contact with the rear end of the nib and having a capillary action is inserted into the inner surface of the barrel such that a ventilation passage connected to the outside air exists from the inner surface of the barrel. In addition, a compressed member is joined to the rear end of the ink reservoir to raise the density of the capillary spaces in the ink reservoir at the foregoing joint portion. Moreover, the rear end of the ink reservoir and the ink tank formed in the rear portion of the barrel are connected to each other through a communication hole.

However, the implement for writing in the publication (a) is an implement for writing of a type having a structure that ink supplied from the ink tank is temporarily absorbed by the ink reservoir so as to consume absorbed ink from the nib. Therefore, in the implement for writing in the publication (a), ink in the ink tank is not directly supplied to the Nib through an ink guide member or the like. Therefore, the quantity of ink which is discharged from the nib is insufficient. Thus, script becomes too light and faint and patchy. Therefore, smooth writing for a long time is not permitted.

Although the implement for writing in the publication (a) has the close capillary spaces in the rear end portion of the ink reservoir because of the compression, the other main portion has straight capillary spaces. Therefore, the widths of the capillary spaces (that is, the capillary forces) are substantially uniform. It leads to a fact that a major portion of ink stored in the ink reservoir can easily be concentrated to a lower portion of the ink reservoir (that is, a front portion of the ink reservoir) when downward attribute of the nib is maintained. As a result, there is apprehension that ink reservoir leaks outwards by dint of an impact which is made when the implement for writing is dropped or when a cap is removed.

Since the implement for writing in the publication (a) easily encounters concentration of ink in the front portion of the ink reservoir, ink in the front portion of the ink reservoir cannot smoothly be returned into the ink tank when the pressure in the ink tank is reduced owning to change in the temperature. Therefore, air can easily be introduced into the ink tank in a state in which ink is retained in the front portion of the ink reservoir. It leads to a fact that ink left in the front portion of the ink reservoir is gradually increased if expansion and contraction of air in the ink tank are repeated. Thus, there is apprehension that ink leaks through the leading end of the nib.

What is worse, the implement for writing in the publication (a) has the arrangement that a major portion of accumulated ink is distributed in the front portion of the ink reservoir and air can easily be introduced into the rear portion of the ink reservoir. Therefore, an air duct connected to the outer air must be formed between the outer surface of the ink reservoir and the inner surface of the barrel. If the air duct is omitted, there is apprehension that ink is undesirably discharged to the outside when air in the rear portion of the ink reservoir is expanded by dint of, for example, rise in the temperature. Therefore, the implement for writing in the publication (a) has the above-mentioned air duct to prevent a fact that air is confined in the rear portion of the ink reservoir. Thus, leakage of ink is prevented.

However, the air dust cannot easily be formed between the inner surface of the barrel and the outer surface of the ink reservoir. Thus, the manufacturing cost is enlarged. If the members including the barrel are made of molded synthetic resin, making of an air duct groove and rib causes surface sink to take place on the outer surface of the barrel. Thus, there is apprehension that the quality of the appearance deteriorates and airtightness which is realized when the cap is put becomes unsatisfactory.

(b) Unexamined Japanese Utility-Model publication No. 2-48377

In the publication (b), an implement for writing having an ink guiding member disposed between an ink tank and the nib has been disclosed. According to the foregoing disclosure, a porous member for adjusting ink in an implement for writing is arranged such that the capillary force of the porous member (corresponding to the ink reservoir according to the present invention) disposed in contact with the ink guiding member and arranged to surround the same is enlarged in a portion adjacent to the ink guiding member. Moreover, the capillary force is reduced in the outer portion.

In the implement for writing in the publication (b), even if the capillary force of the ink reservoir is changed in the radial direction such that it is enlarged in the portion adjacent to the ink guiding member and the same is reduced in the outer portion, the capillary force is uniform in the axial direction. Therefore, if the downward attitude of the nib is maintained, ink is concentrated to the front portion of the ink reservoir similarly to the implement for writing in the publication (a). Thus, there is apprehension that ink is leaked when an impact is made because of drop of the implement for writing or when the cap is removed.

(c) Examined Japanese Utility-Model Publication No. 37-12939

In the foregoing publication (c), a fountain pen type felt pen has been disclosed which incorporates an ink cylinder which includes an ink tank, an ink reservoir disposed in front of the ink tank and formed by felt chips or cotton and a partition wall arranged to insulate the ink reservoir and the ink tank from each other and having a small communication hole. Moreover, an ink guiding member made of elongated felt subject to a resin process penetrates the partition wall and the ink reservoir.

In the direct ink supply writing implement in the publication (c), the overall capillary force in the ink reservoir is uniform. Therefore, if the foregoing implement for writing is stored for a long time in a state in which the nib faces downwards, ink can easily be concentrated to the front portion of the ink reservoir. Therefore, there is apprehension that ink leaks by dint of an impact which is made when the implement for writing is dropped or when the cap is removed.

What is worse, in the direct ink supply writing implement in the publication (c), ink can easily be concentrated to the front portion of the ink reservoir. Moreover, contact between the outer surface of the ink guiding member and the inner surface of the ink reservoir is instable, causing smooth return of ink in the front portion of the ink reservoir into the ink tank to be inhibited when the pressure in the ink tank has been reduced because, for example, the temperature has been changed. Therefore, air can easily be introduced into the ink tank in a state in which ink is left in the front portion of the ink reservoir. If expansion and contraction of air in the ink tank are repeated, residual ink in the front portion of the ink reservoir is gradually increased. As a result, ink leaks through the leading end of the nib.

The direct ink supply writing implement in the publication (c) is a direct ink supply writing implement having the structure that the ink tank and the nib are directly connected to each other through the ink guiding member without the ink reservoir. Therefore, satisfactory ink discharging characteristic can be realized as compared with a type in which the ink guiding member does not penetrate the ink reservoir. However, the realized ink discharging characteristic is insufficient to realize satisfactory ink leakage preventing characteristic.

The reason for this lies in that accurate and uniform capillary space size cannot easily be realized if uniform distribution of capillary space sizes is required. Therefore, the capillary space sizes easily vary. Capillary spaces having large sizes cannot serve as the portion for temporarily store ink. The excessively large capillary spaces deteriorate the overall performance of the ink reservoir for storing ink. Thus, undesirable ink leakage easily takes place. To form an effective ink storage portion in the overall body of the ink reservoir, dense capillary spaces are required. Therefore, the direct ink supply writing implement in the publication (c) inevitably has the structure having the dense capillary spaces in the ink reservoir in order to realize a satisfactory ink leakage preventive characteristic. As a result, air cannot smoothly be introduced into the ink tank, the pressure of which has been reduced. As a result, the ink discharging characteristic from the nib deteriorates. Thus, script becomes too light and faint and patchy.

What is worse, the direct ink supply writing implement in the publication (c) incorporates the ink guiding member which has a simple structure made of the porous material. Therefore, a limit is imposed to quickly and sufficiently supply ink from the ink tank to the nib.

(d) Toku Hyo Hei. No. 6-510491

In the publication (d), a direct ink supply writing implement has been disclosed which has a structure that an ink guiding member is in contact with an ink reservoir in a direct manner. Moreover, the ink guiding member is received in a central hole of a partition wall to close the central hole. A gap (corresponding to the communication hole according to the present invention) exhibiting capillary force superior to that of the ink reservoir and having a function of exchanging air and ink is formed.

In general, the gap limits communication of ink and air between the ink tank and the ink reservoir by dint of the size of the gap. Therefore, a significant accuracy is required for the gap to exchange air and ink.

If the size of the gap is too large, the capillary force is weakened. Thus, smooth return of ink from the ink reservoir to the ink tank is inhibited when the pressure in the ink tank has been reduced. Thus, outer air is introduced into the ink tank in a state in which ink is left in the ink reservoir, causing the state in which the pressure in the ink tank has been reduced to be canceled. If the internal pressure in the ink tank is raised, the ink storage portion cannot satisfactorily store overflowed ink. Thus, there is apprehension that ink leaks from the nib.

If the size of the gap is too small, the capillary force is strengthened. Thus, introduction of air into the ink tank in a pressure reduced state is prevented, causing smooth exchange of air to be prevented. As a result, the pressure reduced state in the ink tank cannot be canceled. Therefore, the quantity of ink which is discharged from the nib is gradually reduced after consumption of ink has been started. It leads to a fact that script becomes too light and faint and patchy.

Since the direct ink supply writing implement in the publication (d) incorporates the ink guiding member which is made of the porous material, such as a fibrous material, the sizes of the plural gaps in the ink guiding member received in the central hole in the partition wall considerably vary. Among the gaps, a largest gap serves as the communication hole for air duct according to the present invention.

To prevent undesirable leakage of ink from the nib because ink is left in the ink reservoir, the largest gap which serves as the communication hole, must have a small size. In consideration of the variation of the gap sizes, the capillary spaces in the ink guiding member which is received in the central hole must considerably be made densely. As a result, the capillary force of the communication hole is enlarged excessively. Thus, outer air cannot easily be introduced into the ink tank in the pressure reduced state. Therefore, the pressure reduced state in the ink tank cannot sufficiently be canceled. Thus, the ink discharging characteristic from the nib gradually deteriorates after consumption of ink has been started.

Since the ink guiding member of the direct ink supply writing implement in the publication (d) is made of the porous material, such as the fibrous material, the overall body has great capillary force. Therefore, a satisfactory large quantity of ink cannot quickly be supplied to the nib. Thus, script becomes too light and faint and patchy.

(e) Examined Japanese Utility-Model Publication No. 55-32787

In the publication (e), a structure has been disclosed in which a communication hole is formed between the outer surface of an ink guiding member. (specifically, a pen member made of a fiber bundle core or an open-cell plastic core) and the inner surface of a central hole of a partition wall having an axial groove.

In the above-mentioned structure (that is, the communication hole is formed between the outer surface of the ink guiding member and the inner surface of the central hole in the partition wall), the ink guiding member is made of fiber or a porous material, such as the open-cell synthetic resin member. Therefore, when the ink guiding member is disposed and secured in the central hole in the partition wall, the outer surface of the ink guiding member is expanded in the groove in the inner surface of the central hole in the partition wall. Therefore, there is apprehension that the communication hole is closed or the communication hole is reduced. Thus, appropriate gap size in the communication hole cannot be realized.

SUMMARY OF THE INVENTION

To solve the problems experienced with the conventional structures, an object of the present invention is to provide a direct ink supply writing implement which is capable of simultaneously satisfying a sufficient characteristic for preventing leakage of ink from the nib and an excellent ink discharging characteristic. More particularly, an object of the present invention is to provide a direct ink supply writing implement with which a communication hole having an appropriate gap size can accurately be formed, which is able to simultaneously satisfying a sufficient ink retention preventive characteristic and a smooth air introducing characteristic and which can easily be manufactured.

[1] A direct ink supply writing implement according to the present invention comprises: an ink reservoir made of a porous material disposed between a nib and an ink tank; a partition wall disposed between the ink reservoir and the ink tank and arranged to partition the ink reservoir and the ink tank from each other; a communication hole formed in the partition wall for establishing communication between the ink reservoir and the ink tank; a rod-shape ink guiding member which penetrates the partition wall and with which ink is supplied from the ink tank to the nib; and a compressed portion formed at a rear end of the ink reservoir and arranged to enhance capillary force as compared with other portions.

Since the compressed portion enhances the capillary force of the rear end of the ink reservoir, an ink barrier can be formed with which ink can always be concentrated to the rear end (that is, the compressed portion) of the ink reservoir even if the nib is faced downwards and which is able to prevent introduction of air when the pressure in the ink tank has been reduced.

The direct ink supply writing implement has the structure that the rod-shape ink guiding member for supplying ink from the ink tank to the nib penetrates the compressed portion and the partition wall. Therefore, ink in the ink tank can be supplied to the nib through the ink guiding member having strong capillary force and exhibiting excellent an ink guiding function without passage through the ink reservoir. Therefore, a large quantity of ink can continuously be discharged from the nib. Therefore, script does not become too light and faint and patchy. Thus, smooth writing can be performed.

The compressed portion can be formed by compressing the the rear end of the ink reservoir in a radial direction (specifically inwards in the radial direction or outwards in the radial direction). Thus, the widths of the capillary gaps in the rear end (the compressed portion) of the ink reservoir are reduced as compared with those in the other front portions. As a result, the capillary force can be enhanced as compared with the other front portions. Specifically, it is preferable that the capillary force of the compressed portion is substantially similar to that of the communication hole. Thus, introduction of air into the ink tank, the pressure of which has been reduced, can smoothly be performed. Moreover, retention of ink in the ink reservoir can satisfactorily be prevented.

[2] It is preferable that the direct ink supply writing implement as described in [1] has a structure that the compressed portion is formed by inwards compressing an outer surface of a rear end of the ink reservoir in a radial direction, and an inner surface of the compressed portion and an outer surface of the ink guiding member are in close contact with each other.

As a result, ink in the ink reservoir in a state in which the pressure in the ink tank has been reduced can continuously be returned into the ink tank through the ink guiding member which is in close contact with the compressed portion without any introduction of air. Thus, ink is not left in the portion of the ink reservoir adjacent to the nib in a large quantity. Therefore, undesirable leakage of ink can be prevented.

[3] It is preferable that the direct ink supply writing implement as described in [1] has a structure that the communication hole is formed into a slit shape extending in an axial direction. Since the slit shape is employed, the capillary force can reliably be set. Thus, an advantage can be obtained in manufacturing.

The communication hole penetrates the partition wall in the axial direction. The compressed portion and the ink tank are communicated with each other through the communication hole. The communication hole is a passage for exchanging ink and air such that ink and air in the ink tank and the ink reservoir are communicated with each other. The size (that is, the capillary force) controls communication of ink and air.

Since the present invention has the structure that the communication hole is not formed by a porous material having varied gaps and the communication hole is formed by the partition wall (non-porous material), an appropriate size (that is, appropriate capillary force) can accurately be set.

[4] It is preferable that the direct ink supply writing implement as described in [1] has a structure that width of the communication hole is 0.02 mm to 0.25 mm.

If the width of the communication hole is smaller than 0.02 mm, the capillary force of the communication hole is enlarged excessively. Therefore, air cannot smoothly be introduced into the ink tank, the pressure of which has been reduced, from outside. As a result, the pressure-reduced state in the ink tank cannot be canceled. Thus, the quantity of ink which is discharged from the nib becomes insufficient. Thus, there is apprehension that script become faint and patchy.

If the width of the communication hole is larger than 0.25 mm, the capillary force of the communication hole is reduced excessively. Therefore, outer air can easily be introduced into the ink tank, the pressure of which has been reduced, before a major portion of ink in the ink reservoir is returned into the ink tank. Thus, ink can easily be left in the ink reservoir.

If ink has a relatively low surface tension (for example, oil based ink), it is preferable that the width is 0.02 mm to 0.15. If ink has relatively high surface tension (for example, water-color ink), it is preferable that the width is 0.03 mm to 0.2 mm.

If ink has a relatively low surface tension (for example, white board ink having a surface tension of 20 mN/m to 25 mN/m), it is preferable that the width is 0.03 mm to 0.1 mm.

Thus, air can furthermore smoothly be introduced into the ink tank from outside. Moreover, leaving of ink in the ink reservoir can be prevented. More preferably, the width is 0.03 mm to 0.08 mm to reliably obtain the foregoing effect.

[5] It is preferable that the direct ink supply writing implement as described in [4] has a structure that an outer surface of the partition wall is press-fit into an inner surface of the barrel, and the slit-shape communication hole extending in an axial direction and in a circumferential direction is formed between an inner surface of the barrel and an outer surface of the partition wall.

The above-mentioned structure is arranged to form the communication hole by combining the two members (that is, the inner surface of the barrel and the outer surface of the partition wall). Therefore, the necessity of forming a slit extending in the radial direction in the partition wall, which is a sole element can be eliminated, as has been required for the conventional structure. Therefore, difficulty in manufacturing (that is, difficulty in molding synthetic resin or in performing a cutting work) experienced with the conventional structure can be eliminated. Thus, the accurate communication hole can arbitrarily be formed such that the width can be varied. Therefore, arbitrary capillary force of the communication hole can easily be set. In particular, an accurate communication hole having a small width can easily be formed. The ink guiding member and the like having an instable shape for forming the communication hole is not used as has been used in the conventional structure. Thus, a communication hole having a required width can reliably and easily be obtained.

To form the communication hole by the inner surface of the barrel and the outer surface of the partition wall, the overall contact between the inner surface of the barrel and the outer surface of the partition wall must be prevented at the press-fitting position of the inner surface of the barrel or the outer surface of the partition wall. Thus, the two elements must have different shapes to form a gap between the two elements.

The inner surface of the barrel may be, for example, a structure in which a member is integrally formed on the inner surface of the synthetic resin barrel or a structure in which an individual synthetic resin member is joined to the inner surface of the barrel. Similarly, the outer surface of the partition wall may be, for example, a structure in which a member is integrally formed on the outer surface of the synthetic resin partition wall or a structure in which an individual member is joined to the outer surface of the synthetic resin partition wall.

The communication hole has the slit shape extending in the axial direction and the circumferential direction. Moreover, the width is smaller than the width in the circumferential direction so that the capillary force in the radial direction is made to be larger than that in the circumferential direction.

[6] It is preferable that the direct ink supply writing implement as described in [1] has a structure that a rear end of the small-diameter and straight compressed portion and a front surface of the partition wall are in contact with each other. Thus, reliable passage of ink is permitted between the ink tank and the compressed portion through the communication hole.

[7] It is preferable that the direct ink supply writing implement as described in [1] has a structure that the ink guiding member is a porous member. Thus, the ink guiding member can be provided with which ink can smoothly be moved in the lengthwise direction in the ink reservoir and smooth discharge of ink from the ink tank to the nib is enabled with a low cost.

[8] It is preferable that the direct ink supply writing implement as described in [7] has a structure that an ink discharge passage is provided for an inside portion of the ink guiding member, the ink discharge passage having a leading end disposed adjacently to a portion adjacent to a leading end of the nib and a rear end which is opened in the ink tank.

Even if the direct ink supply writing implement has a structure disadvantageous to discharge ink (that is, dense capillary spaces are provided in the ink reservoir to sufficiently prevent leakage of ink from the nib and the ink guiding member made of a porous material is employed), the ink discharge passage in the ink guiding member causes ink to sufficiently and quickly be discharged from the ink tank to the nib. Therefore, an adequate quantity of ink can continuously be discharged from the nib. Thus, script does not become too light and faint and patchy. Therefore, the function of the ink reservoir for storing ink does not deteriorate. As a result, the direct ink supply writing implement can be provided with which leakage of ink from the nib can satisfactorily be prevented and which has a satisfactory characteristic for discharging ink from the nib.

[9] It is preferable that the direct ink supply writing implement as described in [8] has a structure that capillary force of an outer wall of the ink guiding member is made to be larger than capillary force of the ink reservoir and capillary force of the ink discharge passage.

The outer wall of the ink guiding member is in close contact with the inner surface of the ink reservoir so as to mainly smooth lengthwise movement of ink in the ink reservoir. When the capillary force of the ink guiding member is made to be larger than the capillary spaces in the ink reservoir, a satisfactory effect of the ink guiding member can be obtained. The ink discharge passage in the ink guiding member has capillary force smaller than that of the outer wall of the ink guiding member. As a result, the ink discharge passage has a function for quickly and sufficiently discharge ink from the ink tank to the nib.

Therefore, in the above-mentioned structure, when the pressure in the ink tank has been reduced because of, for example, consumption of ink during writing, ink in the ink reservoir is continuously and smoothly returned to the ink tank along the outer wall of the ink guiding member. Thus, retention of ink in the ink reservoir can be prevented. Simultaneously, the ink discharge passage causes ink supplied from the ink tank to sufficiently be discharged from the nib when writing is performed.

The ink discharge passage is simply required to have capillary force which is smaller than that of the outer wall. For example, any one of a structure in which an axial hole (for example a gap size of 5 mm or larger) having substantially no capillary force is formed; a structure in which an individual member having an axial hole or a groove having a gap size to have capillary force smaller than that of the outer wall is inserted into the axis of the ink guiding member; and a structure in which an individual member made of a low density porous material to have capillary force smaller than that of the outer wall is inserted into the axis of the ink guiding member.

[10] It is preferable that the direct ink supply writing implement as described in [9] has a structure that a liquid accumulating portion for liquid-sealing an opening of a rear end of the ink discharge passage is provided for a rear end of the ink guiding member.

Ink is always accumulated in the liquid accumulating portion. Accumulated ink liquid-seals the opening of a rear end of the ink discharge passage. That is, even if the remainder of ink in the ink tank is small and if the implement for writing is in state between a horizontal state and a state in which the nib is stood erect, the opening at the rear end of the ink discharge passage is liquid-sealed. As a result, air cannot easily be introduced into the ink discharge passage. Thus, the ink discharge passage can always be filled with ink. As a result, even if the nib is in a state other than the downward state, a stable ink discharging characteristic can be maintained.

Specifically, the liquid accumulating portion may be formed such that a cylinder having a bottom surrounds a rear end surface of the ink guiding member in which the ink discharge passage is opened and an outer surface adjacent to the rear end of the ink guiding member continued from the foregoing rear end surface so as to form a small gap (that is, the liquid accumulating portion).

[11] It is preferable that the direct ink supply writing implement as described in [8] has a structure that a nib made of a porous material is provided for a leading end of the ink guiding member and length of a wall from a leading end of the ink discharge passage to a leading end of the nib is made to be 1 mm to 20 mm (claim 16).

If the wall thickness is smaller than 1 mm, there is apprehension that ink is excessively discharged from the nib and that the nib is worn in a short time. Thus, the ink discharge passage is opened in the nib. Thus, there is apprehension that ink is undesirably discharged. If the wall thickness is larger than 20 mm, the ink discharging characteristic from the nib deteriorates. Thus, there is apprehension that script becomes too light and faint and patchy.

PREFERRED EMBODIMENTS OF THE INVENTION

Figure 1:
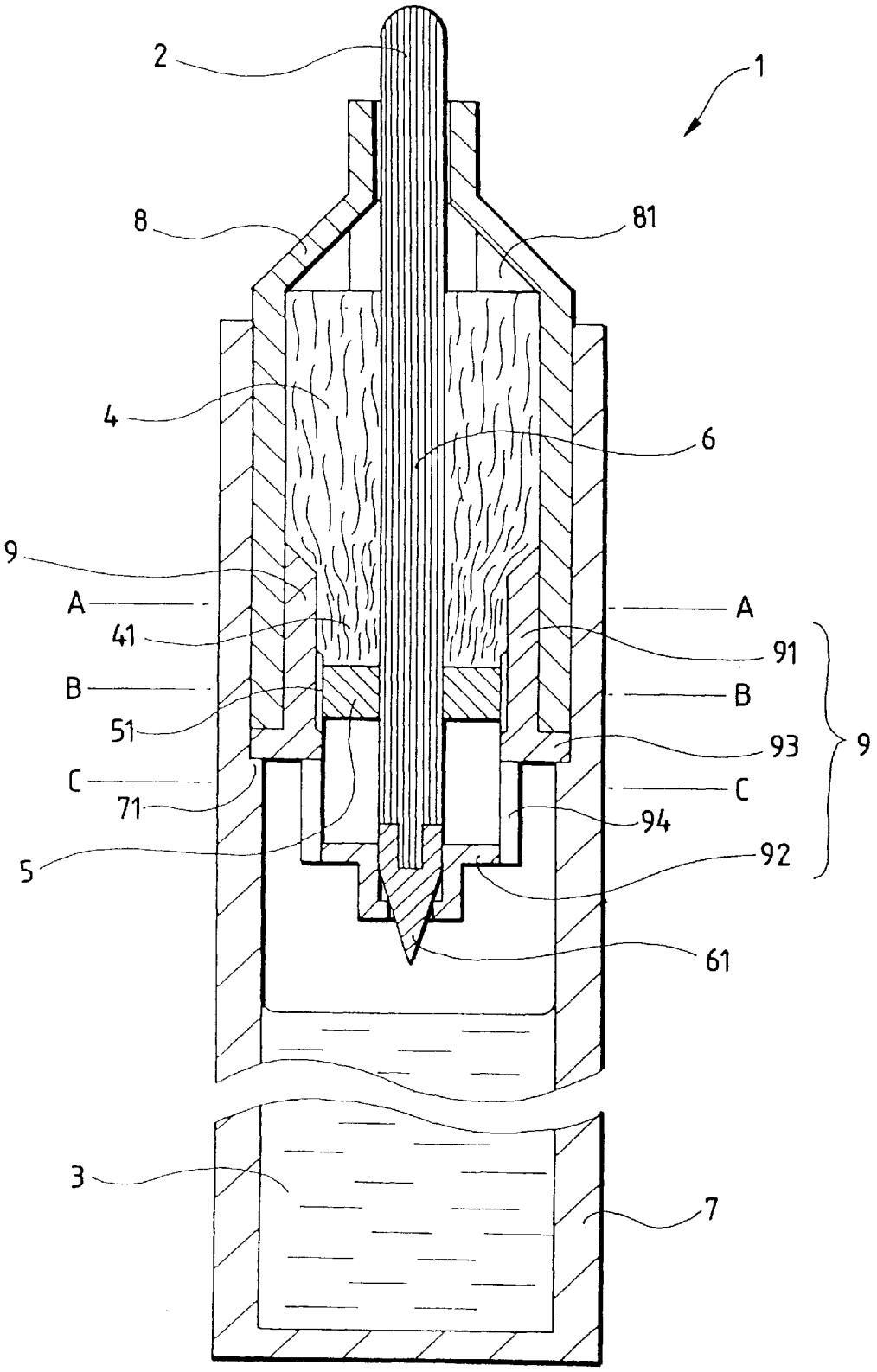
FIG. 1 is a vertical cross sectional view of a first embodiment of the present invention.
Figure 2:
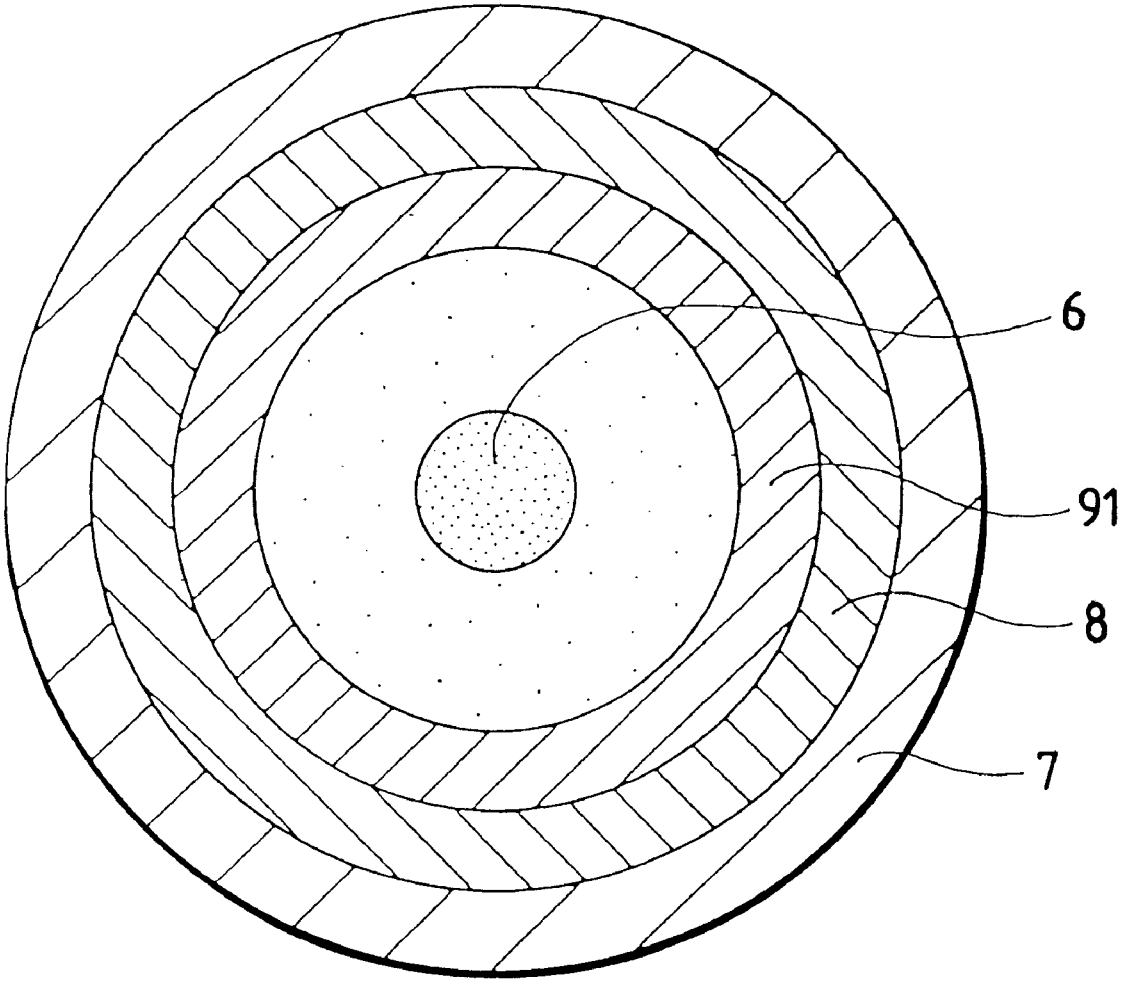
FIG. 2 is an enlarged cross sectional view taken along line A—A shown in FIG. 1.
Figure 3:
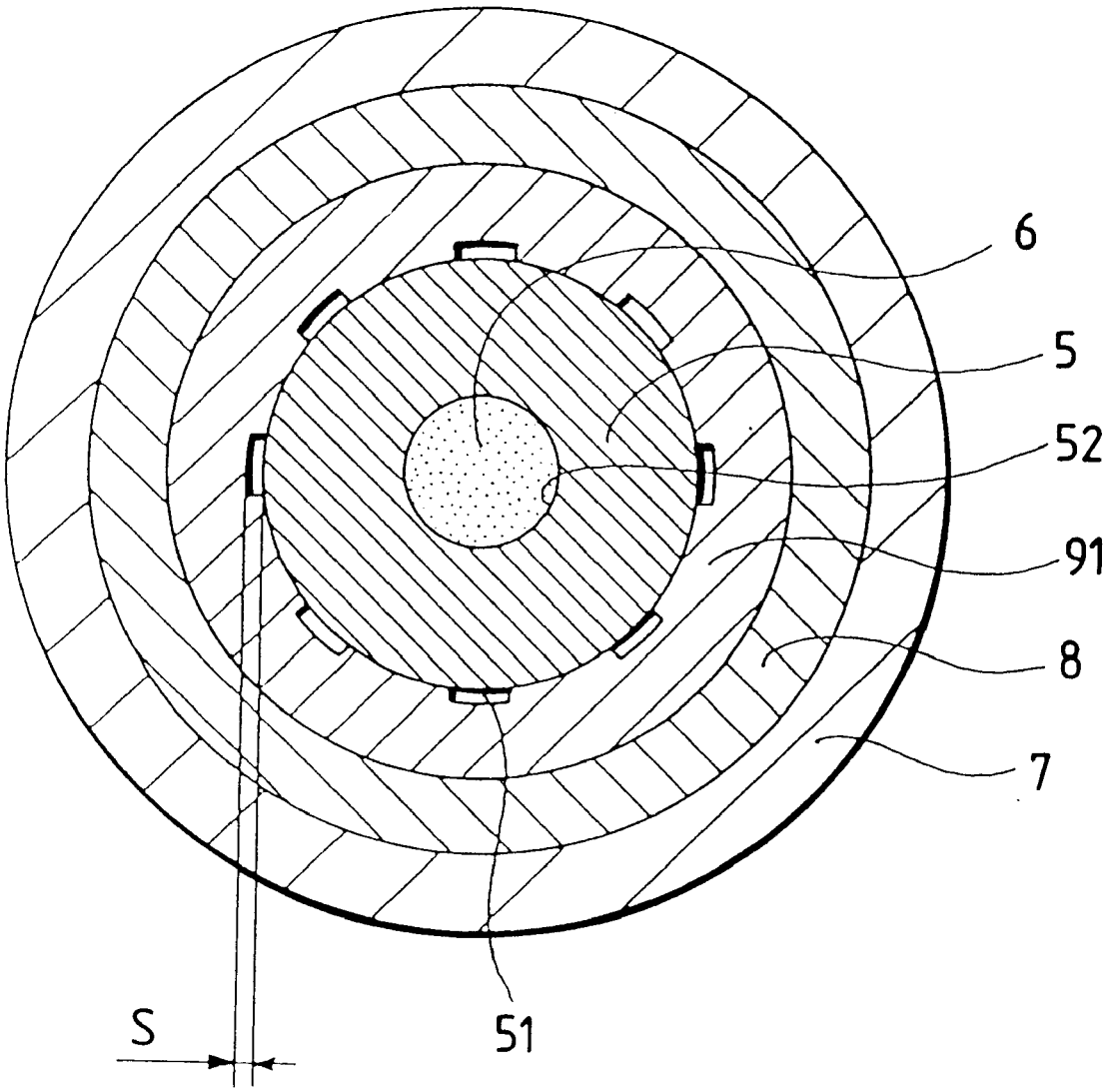
FIG. 3 is an enlarged cross sectional view taken along line B—B shown in FIG. 1.
Figure 4:
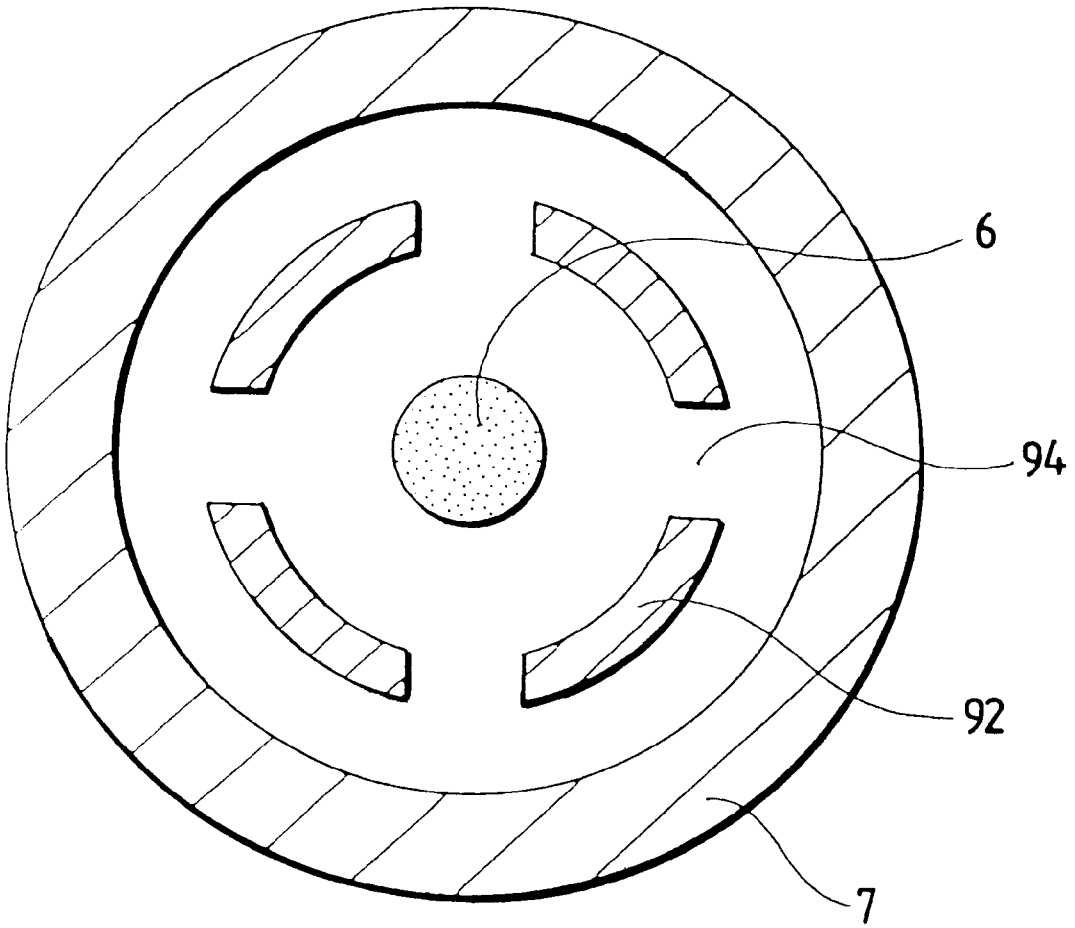
FIG. 4 is an enlarged cross sectional view taken along line C—C shown in FIG. 1.

Preferred embodiments according to the present invention will be described as follows referring to the accompanying drawings.

First Embodiment

FIGS. 1 to 4 show a direct ink supply writing implement 1 according to a first embodiment of the present invention. The direct ink supply writing implement 1 according to this embodiment incorporates a storage cylinder 8 for accommodating an ink reservoir 4; a barrel 7 having the storage cylinder 8 in the front portion thereof and an ink tank 3 formed in the rear of the storage cylinder 8 through a partition wall 5; and an ink guiding member 6 which axially penetrate the ink reservoir 4 of the barrel 7 which has a rear end which appears in the ink tank 3 and which has a front end formed into a nib 2 which projects outwards.

The storage cylinder 8 is formed into a cylindrical shape having a front portion which holds the nib 2 and accommodating the ink reservoir 4. A cylindrical reducing diameter member 9 is secured to the inner surface of a rear end of the storage cylinder 8. The inner diameter of the rear portion of the storage cylinder 8 is reduced.

The ink reservoir 4 made of a material manufactured by melting a synthetic fiber bundle (for example, a fiber bundle made of polyester resin and oriented in the lengthwise direction) is press-fit into the storage cylinder 8 through the opening at the rear end of the storage cylinder 8. At this time, the rear end portion of the ink reservoir 4 is compressed inwards in the radial direction by the reducing diameter member 9 so that a compressed portion 41 is formed. The ink reservoir 4 has a straight cylindrical shape before it is press-fit into the storage cylinder 8. Thus, the ink reservoir 4 has uniform capillary spaces (that is, uniform capillary force). Therefore, when the compressed portion 41 at the rear end of the ink reservoir 4 has dense capillary spaces by dint of the compression and deformation. Thus, the compressed portion 41 has capillary force larger than that of the other portions of the ink reservoir 4.

The storage cylinder 8 has a tapered front portion which holds the nib 2 such that flow of air is permitted. A support rib 81 is provided on the inner surface of the storage cylinder 8 so as to be in contact with the front end of the ink reservoir 4 and support the same. Thus, separation of the ink reservoir 4 can be prevented.

The rod shape ink guiding member 6 made of processed synthetic resin (for example, polyester resin or acrylic resin) is inserted into the axis of the ink reservoir 4 such that the ink guiding member 6 is rearwards inserted from a front portion of the ink reservoir 4 so as to be joined to the ink reservoir 4. The outer surface of the ink guiding member 6 is in direct contact with the inner surface of the ink reservoir 4. In particular, the outer surface of the ink guiding member 6 is brought into strongly contact with the inner surface of the rear end portion of the ink reservoir 4 in the radial direction by the compressed portion 41 formed by inward compressing and deforming the rear end portion of the ink reservoir 4 in the radial direction. As a result, the connection of ink in the ink reservoir 4 and that in the ink guiding member 6 can be stabilized. Moreover, separation of the ink guiding member 6 from the front portion of the barrel 7 can be prevented.

A hard sharp member 61 is secured to the rear end of the ink guiding member 6 so that an insertion characteristic into the ink reservoir 4 is improved. The front end of the ink guiding member 6 is formed into an arbitrary shape so that a nib 2 projecting forwards and outwards is formed.

The reducing diameter member 9 has a cylindrical front portion 91 so as to reduce the diameter of the rear end portion of the ink reservoir 4. A cylindrical rear portion 92 projects into the ink tank 3 so as to hold the sharp member 61 at the rear end of the ink guiding member 6. The cylindrical rear portion 92 has an opening 94 for establishing the communication between the ink tank 3 and the ink guiding member 6 and establishing the communication between the ink tank 3 and the rear surface of the partition wall 5. A flange 93 is formed between the cylindrical front portion 91 and the cylindrical rear portion 92 in a continuous manner. The flange 93 is axially held between the rear end of the storage cylinder 8 and a stepped portion 71 on the inner surface of the barrel 7.

The partition wall 5 is made of a disc shape non-porous material which is press-fit and secured in the reducing diameter member 9. A plurality (specifically, eight) of axial grooves are formed on the inner surface of the reducing diameter member 9. When the partition wall 5 is press-fit to a position of the grooves in the inner surface of the reducing diameter member 9, a slit shape communication hole 51 axially extending between the outer surface of the partition wall 5 and the inner surface of the reducing diameter member 9 is formed. The communication hole 51-has a horizontal cross sectional shape formed into a circular arc shape or a rectangular elongated hole having uniform groove width S. The groove width S (that is, the groove width in the radial direction) is set to be 0.04 mm to 0.07 mm. A central hole 52 is formed through the axis of the partition wall 5 so as to receive the ink guiding member 6. The overall inner surface of the central hole 52 and the overall outer surface of the ink guiding member 6 are in contact with each other. The front surface of the partition wall 5 and the rear end portion (that is, the compressed portion 41) of the ink reservoir 4 is in contact with each other in the axial direction.

In the direct ink supply writing implement 1 according to the first embodiment, ink in the ink tank 3 is discharged and absorbed by the ink reservoir 4 when the internal pressure of the ink tank 3 has been raised. The discharged ink is continuously held in a region from the compressed portion 41 at the rear end of the ink reservoir 4 to the ink reservoir 4 in front of the compressed portion 41 without existence of air. Therefore, when the pressure in the ink tank 3 has been reduced, return back of ink from the front portion of the ink reservoir 4 to the ink tank 3 can be performed smoothly without any interruption because introduction of air can be prevented.

Second Embodiment

Figure 5:
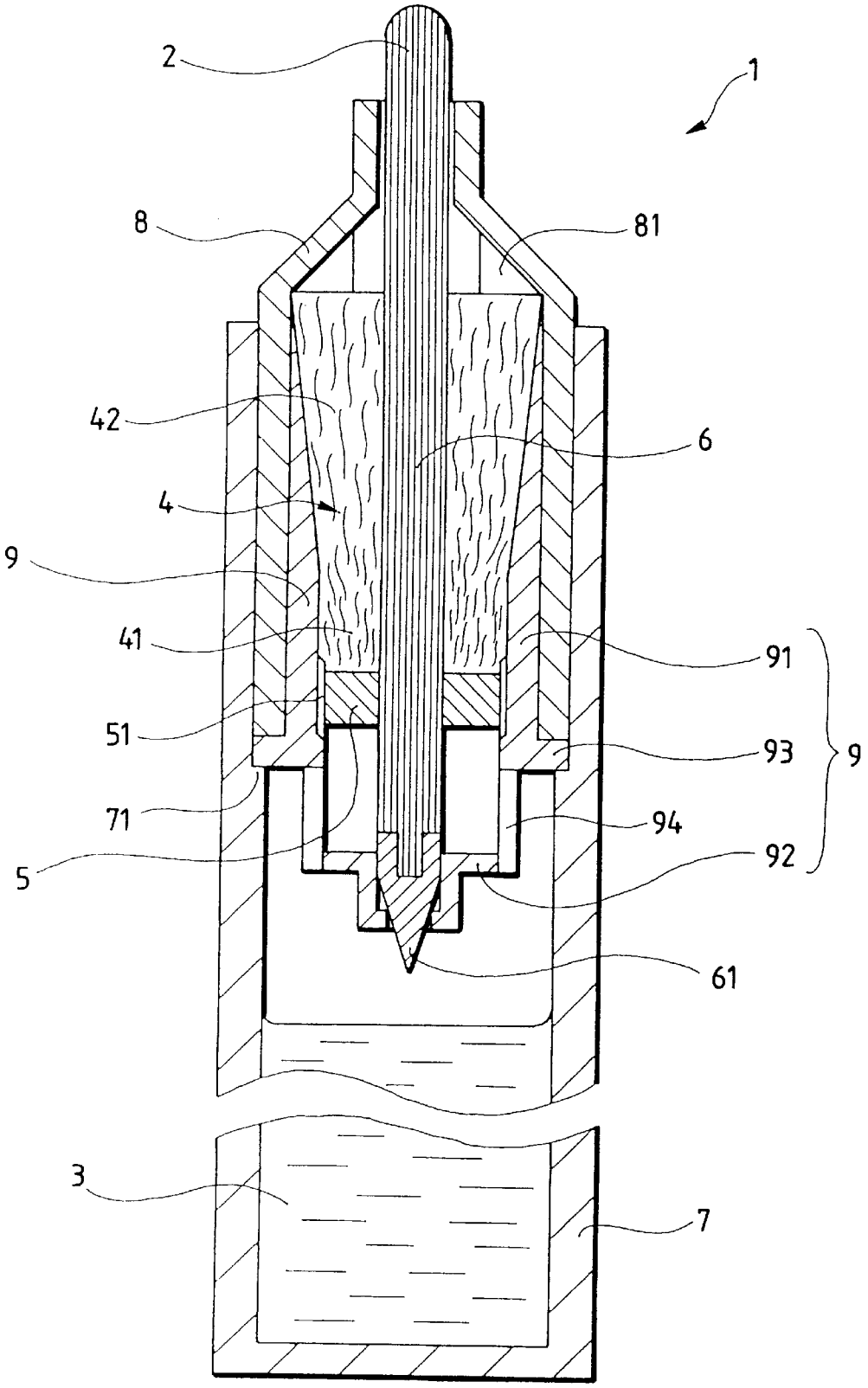
FIG. 5 is a vertical cross sectional view of a second embodiment of the present invention.

FIG. 5 shows a direct ink supply writing implement 1 according to a second embodiment of the present invention.

This embodiment is a modification of the first embodiment. The difference from the first embodiment lies in that the reducing diameter member 9 compresses the outer surface of the ink reservoir 4 in front of the compressed portion 41 into a tapered shape. The other structures are the same as those of the first embodiment.

The cylindrical front portion 91 of the reducing diameter member 9 is press-fit into the storage cylinder 8 so as to reduce the diameter of the ink reservoir 4. The inner surface of the front portion 91 of the reducing diameter member 9 has a conical inner surface having the diameter which is gradually reduced from the front end opening in the rearward direction; and a straight cylindrical inner surface connected to the inner surface of the conical inner surface. When the cylindrical front portion 91 is press-fit into the storage cylinder which accommodates the ink reservoir, the outer surface of the ink reservoir 4 is inwards compressed in the radial direction by the inner surface of the cylindrical front portion 91. Thus, the tapered compressed portion 42 and the straight compressed portion 41 are formed.

Third Embodiment

Figure 6:
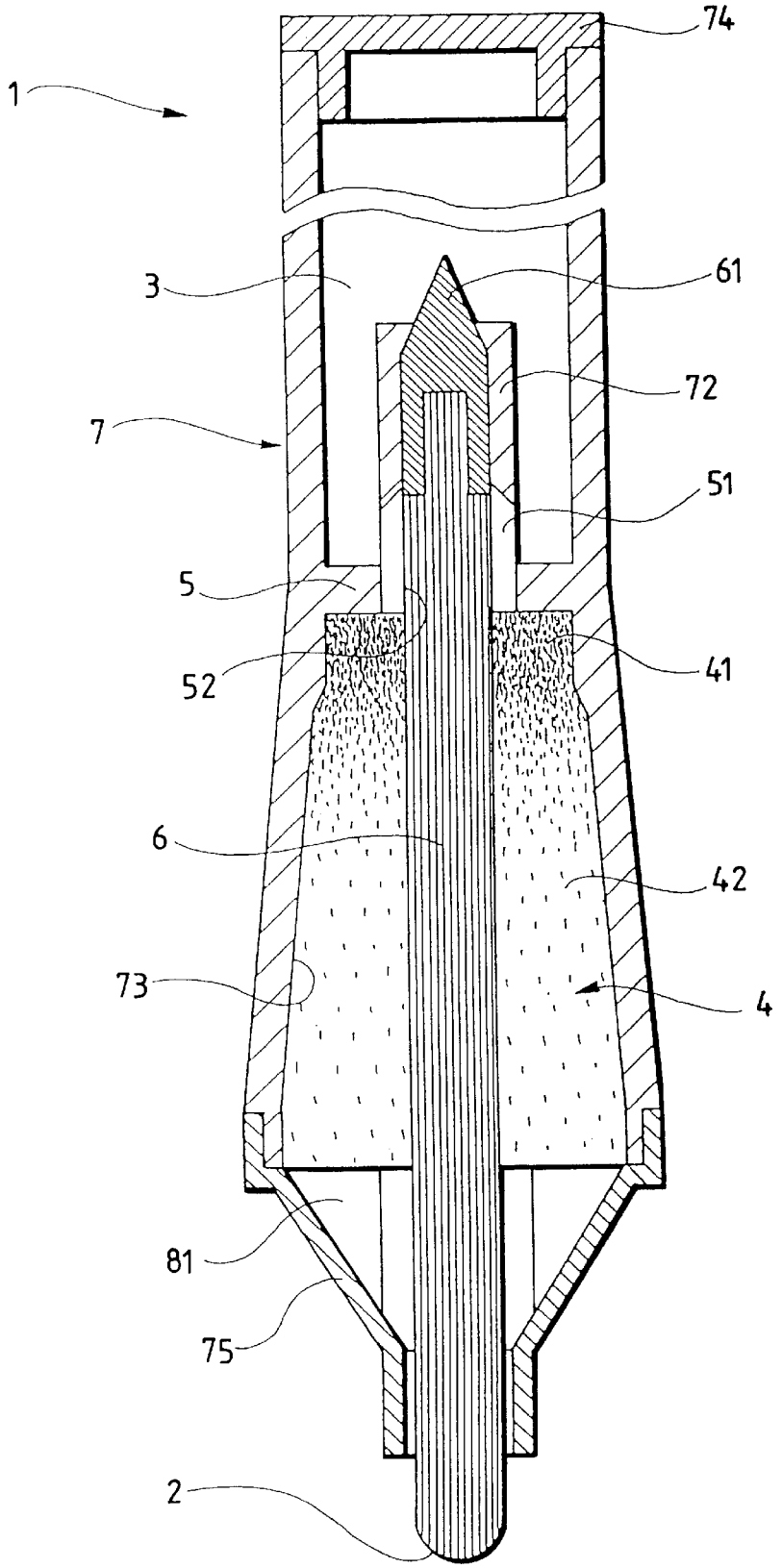
FIG. 6 is a vertical cross sectional view of a third embodiment of the present invention.
Figure 7:
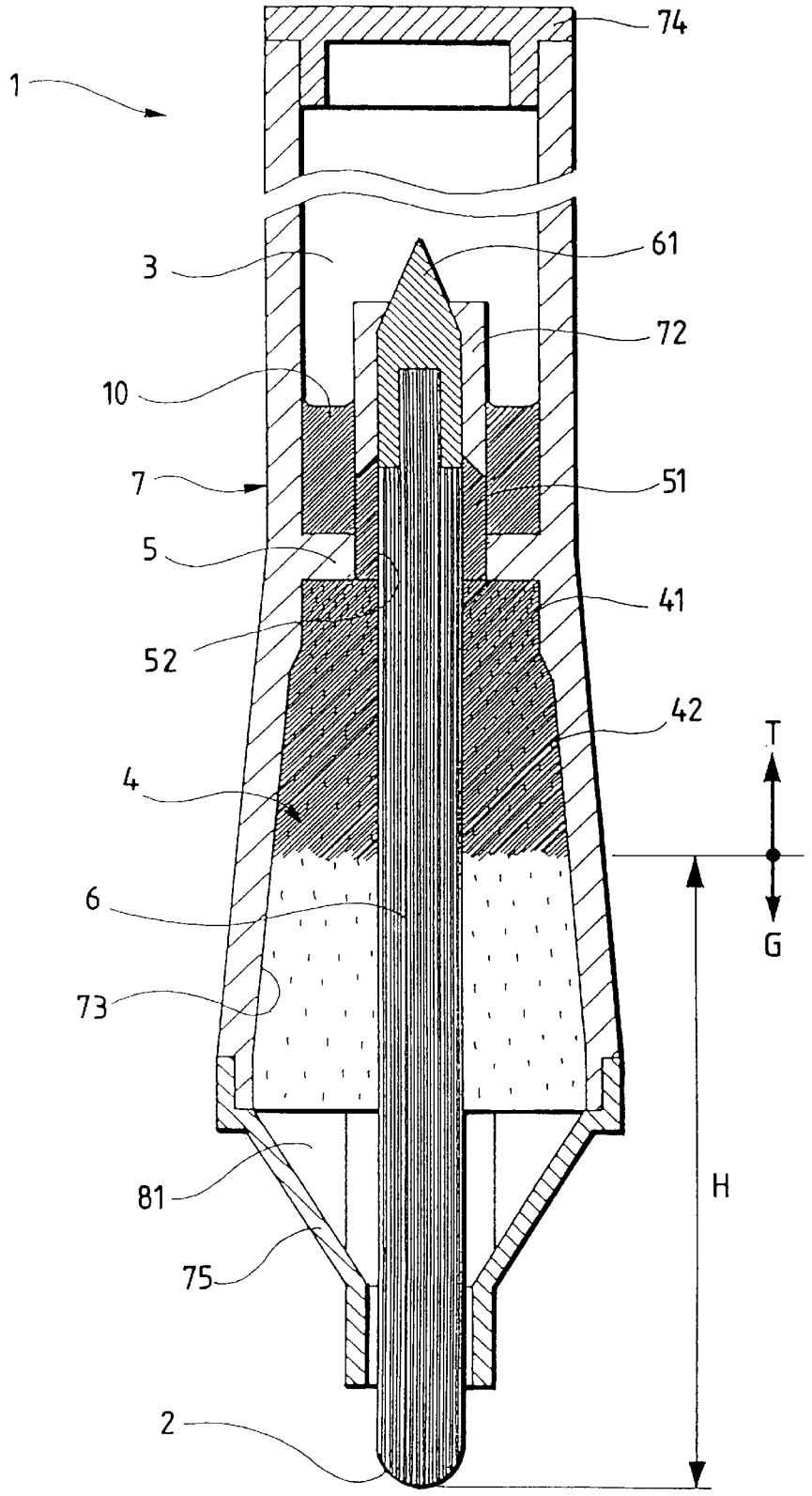
FIG. 7 is a diagram showing the operation of the embodiment shown in FIG. 6.

FIGS. 6 and 7 show a third embodiment of the direct ink supply writing implement 1 according to the present invention. FIG. 6 shows a state in which no ink is accommodated. FIG. 7 shows a state in which ink is stored and the nib is faced downwards.

The direct ink supply writing implement 1 has the barrel 7 having an reservoir accommodating portion 73 in the front portion thereof and the ink tank 3 in the rear portion thereof; the ink reservoir 4 accommodated in the reservoir accommodating portion 73; and an ink guiding member 6 which is axially inserted into the ink reservoir 4 and which also serves as the nib 2.

The barrel 7 is a cylindrical member manufactured by injection molding synthetic resin (for example, polyethylene, polypropylene or the like). The reservoir accommodating portion 73 having a reduced-diameter and tapered inner surface, the diameter of which is gradually reduced in the rearward direction, is formed in the front of the barrel 7. In the rear of the reservoir accommodating portion 73, the ink tank 3 which is a space for directly accumulating ink 10 is formed through the partition wall 5. A tail cap 74 is secured to the rear end opening of the ink tank 3 in the barrel 7.

The ink reservoir 4 made of a material manufactured by melting a synthetic fiber bundle (for example, a fiber bundle made of polyester resin) is press-fit into the reservoir accommodating portion 73 from the front end opening. The ink reservoir 4 has a straight cylindrical shape before it is press-fit into the reservoir accommodating portion 73. Therefore, the ink reservoir 4 has uniform capillary spaces (that is, uniform capillary force). The inner surface of the reservoir accommodating portion 73 is formed into a tapered shape, the diameter of which is gradually reduced toward the rear end. Therefore, the ink reservoir 4 is compressed along the tapered inner surface so that the density of fibers is continuously raised in a direction from the front end to the rear end. Thus, the tapered compressed portion 42 having the capillary force which is gradually enlarged from the front end to the rear end is formed. Moreover, a straight inner surface having a diameter smaller than that of the tapered inner surface is formed at the rear end of the tapered inner surface of the reservoir accommodating portion 73. Therefore, the rear end portion of the ink reservoir 4 is straight compressed so that the straight compressed portion 41 (a liquid seal portion) is formed.

The rod shape ink guiding member 6 made of processed synthetic resin (for example, polyester resin or acrylic resin) is inserted into the axis of the ink reservoir 4 such that the ink guiding member 6 is rearwards inserted from a front portion of the ink reservoir 4 so as to be joined to the ink reservoir 4. The outer surface of the ink guiding member 6 is in direct contact with the inner surface of the ink reservoir 4 (that is, the tapered compressed portion 42 and the straight compressed portion 41). The hard sharp member 61 is secured to the rear end of the ink guiding member 6. Thus, the insertion characteristic into the ink reservoir 4 can be improved. The front end of the ink guiding member 6 is formed into an arbitrary shape so as to be formed into the nib 2 which outwards and forwards projects.

A cylindrical support portion 72 for holding the sharp member 61 at the rear end of the ink guiding member 6 is provided for the partition wall 5 such that the cylindrical support portion 72 projects into the ink tank 3. The slit-shape communication hole 51 (having a groove width S: 0.03 mm to 0.1 mm) extending in the axial direction is provided for the cylindrical support portion 72, the communication hole 51 being arranged to establish the communication between the ink tank 3 and the ink guiding member 6 and establish the communication between the ink tank 3 and the ink reservoir 4 (the straight compressed portion 41).

A nib holding member 75 is secured to the opening at the front end of the barrel 7 so as to hold the outer surface of the nib 2. The nib holding member 75 has a support rib 81 formed on the inner surface thereof so as to be brought into contact with the front end of the ink reservoir 4. Thus, the foregoing front end is supported so that separation of the ink reservoir 4 is prevented.

FIG. 7 shows the operation of the direct ink supply writing implement 1 shown in FIG. 6. Assuming that the height from the nib 2 to an arbitrary position of the ink reservoir 4 is H, the capillary force at the arbitrary position in the ink reservoir 4 is T and the water head of the nib at the foregoing height H is G, the capillary force T is greater than the water head G of the nib (that is, T>G). Moreover, the difference (T−G) between the foregoing capillary force T and the water head G of the nib is gradually enlarged from the front end of the ink reservoir 4 toward the rear end of the ink reservoir 4.

Therefore, when the ink tank 3 is filled with ink and storage is performed such that the nib 2 is faced downwards, ink 10 in the ink tank 3 is discharged to the ink reservoir 4 to correspond to change in the internal pressure of the ink tank 3. Discharged ink is stored continuously in the straight compressed portion 41 at the rear end of the ink reservoir 4 and the ink reservoir 4 (that is, the tapered compressed portion 42) in front of the straight compressed portion 41 without introduction of air. As a result, return back of ink from the ink reservoir 4 to the ink tank 3 can smoothly be performed without any interruption when the pressure in the ink tank 3 has been reduced.

In a state in which the nib is faced downwards, the water head G of the nib is changed in accordance with the height H from the nib 2 to an arbitrary position of the ink reservoir 4. That is, the water head is expressed such that G=(ink density ρ)×(gravitational acceleration g)×(height H). The water head acts on the direction of the nib (the downward direction). The capillary force T of the ink reservoir 4 is determined- by the sizes of the gaps in the porous material (that is, the density of the porous material), the capillary force T acting on the direction of the ink tank (upward direction).

If a case contrary to the present invention such that capillary force T is smaller than the water head G of the nib (that is, in a case where T<G), there is apprehension that ink is stored in the front portion of the ink reservoir 4 with a priority to the rear portion of the ink reservoir 4 as has been experienced with the conventional structure. Also in a case where the different (T−G) between the capillary force T and the water head G of the nib is gradually reduced from the front portion of the ink reservoir 4 toward the rear portion of the ink reservoir 4, there is apprehension that ink is stored in the front portion of the ink reservoir 4 with a priority to the rear portion of the ink reservoir 4 when the nib is faced downwards, as has been experienced with the conventional structure.

Fourth Embodiment

Figure 8:
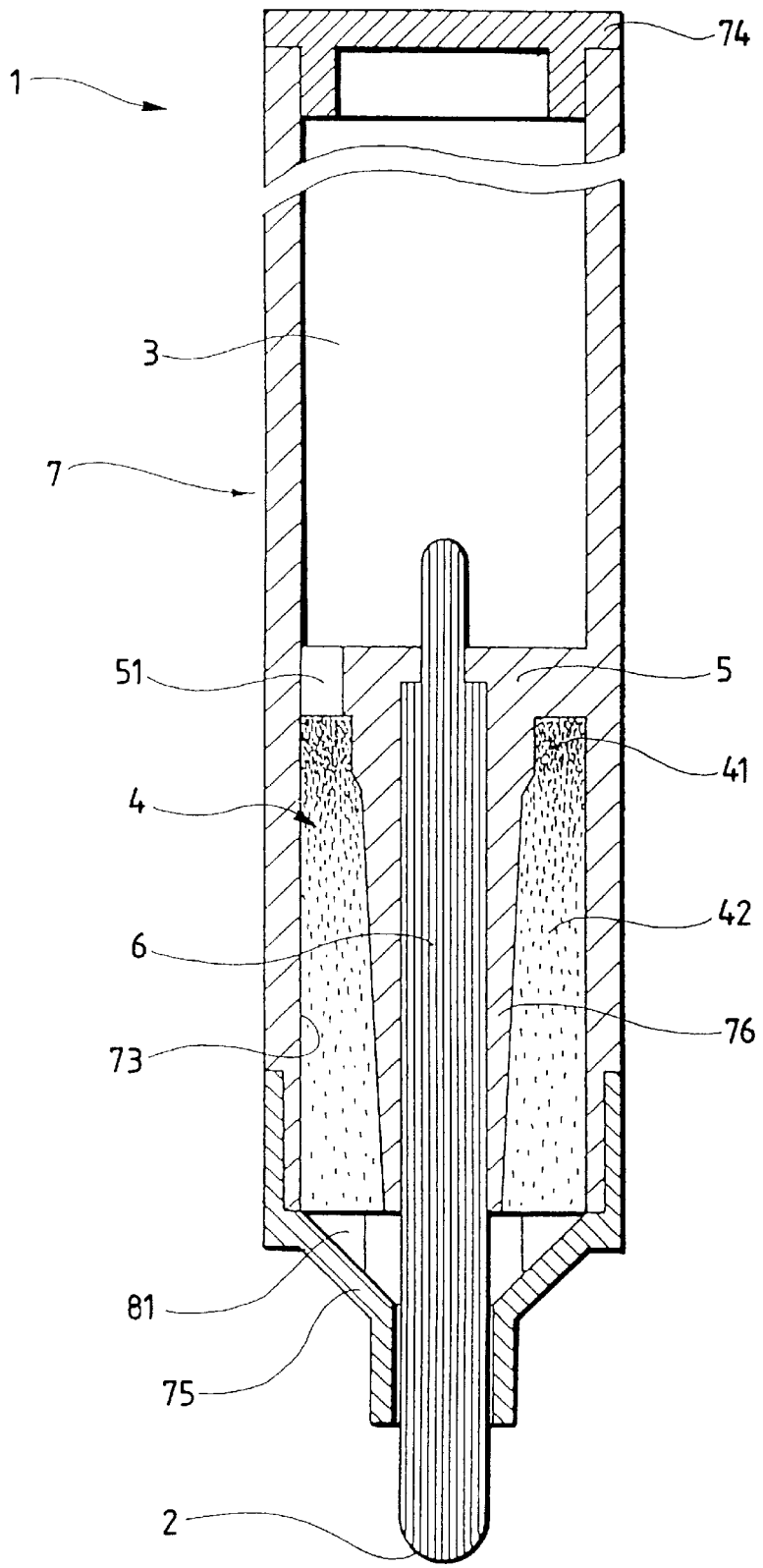
FIG. 8 is a vertical cross sectional view showing a fourth embodiment of the present invention.

FIG. 8 shows a fourth embodiment of the direct ink supply writing implement 1 according to the present invention.

The direct ink supply writing implement 1 incorporates the barrel 7 having the reservoir accommodating portion 73 in the front portion thereof and the ink tank 3 in the rear portion thereof; the ink reservoir 4 accommodated in the reservoir accommodating portion 73; and the ink guiding member 6 inserted into the ink reservoir 4 in the axial direction and also serving as the nib 2.

The barrel 7 has a cylindrical shape and manufactured by injection molding synthetic resin (for example, polypropylene, polyethylene or the like). An annular reservoir accommodating portion 73 having an insertion portion 76 having a diameter which is gradually reduced in the forward direction in the axis thereof is provided for the front portion of the barrel 7. The ink tank 3 which is a space for directly accumulating ink is formed in the rear of the reservoir accommodating portion 73 through the partition wall 5. The tail cap 74 is secured to the rear end opening of the ink tank 3 in the barrel 7.

The partition wall 5 has the slit-shape communication hole 51 (groove width S: 0.04 mm to 0.07 mm) arranged to establish the communication between the ink tank 3 and the ink reservoir 4 and extending in the axial direction and the radial direction. Moreover, the insertion portion 76 forwards projecting toward the reservoir accommodating portion 73 is integrally formed with the partition wall 5. The insertion portion 76 has a base portion formed into a straight outer surface and tapered outer surface, the diameter of which is gradually reduced from the straight outer surface toward the front portion.

The ink reservoir 4 made of a material prepared by thermally processing a synthetic resin fiber bundle (for example, a polyester fiber bundle) is press-fit into the reservoir accommodating portion 73 from the front opening. The reservoir accommodating portion 73 has the insertion portion 76 at the axis portion thereof. Therefore, when the ink reservoir 4 is press-fit, the insertion portion 76 is inserted into the axis of the ink reservoir 4. Thus, the inner surface at the axis of the ink reservoir 4 is compressed along the tapered outer surface and the straight outer surface of the insertion portion 76. The foregoing tapered outer surface forms the tapered compressed portion 42 in which the intervals of the capillary spaces are gradually and continuously reduced toward the rear portion and the capillary force is gradually enlarged from the front portion to the rear portion. Simultaneously, the straight outer surface forms the straight compressed portion 41 (the liquid seal portion).

The ink guiding member 6 made of a resin material prepared by processing synthetic resin fiber (for example, polyester fiber, acrylic fiber or the like) is inserted into the axis of the insertion portion 76. The rear end of the ink guiding member 6 projects into the ink tank 3, while the front end of the ink guiding member 6 serving as the nib 2 projects outwards over the front end of the barrel 7. The outer surface of the ink guiding member 6 is not in contact with the ink reservoir 4.

Similarly to the third embodiment, the nib holding member 75 is secured to the front end opening of the barrel 7 so that the outer surface of the nib 2 is held. The nib holding member 75 has the support rib 81 on the inner surface thereof. The support rib 81 is in contact with the front end of the ink reservoir 4 so that the foregoing front end is supported. As a result, separation of the ink reservoir 4 can be prevented.

Fifth Embodiment

Figure 9:
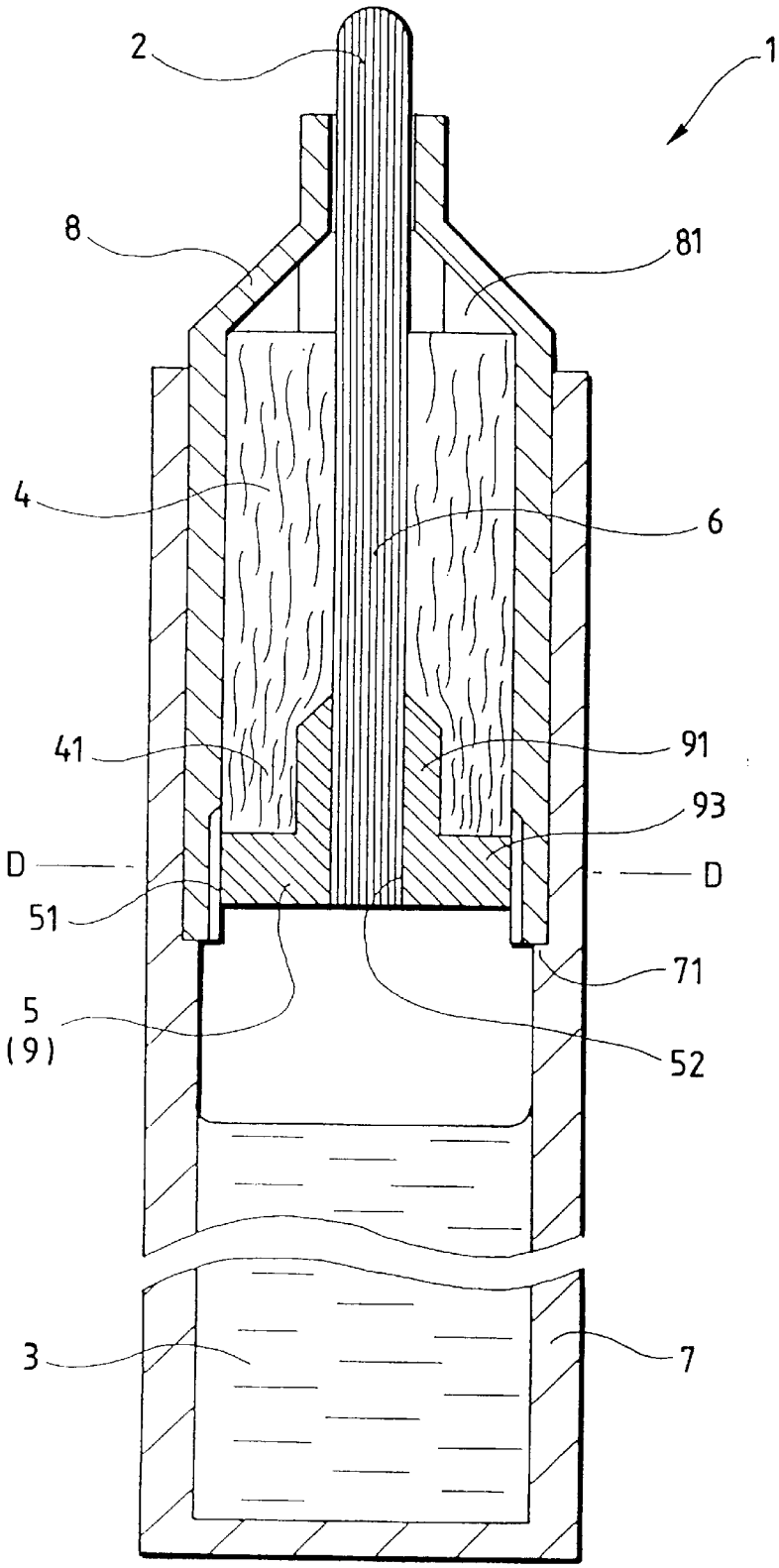
FIG. 9 is a vertical cross sectional view showing a fifth embodiment of the present invention.
Figure 10:
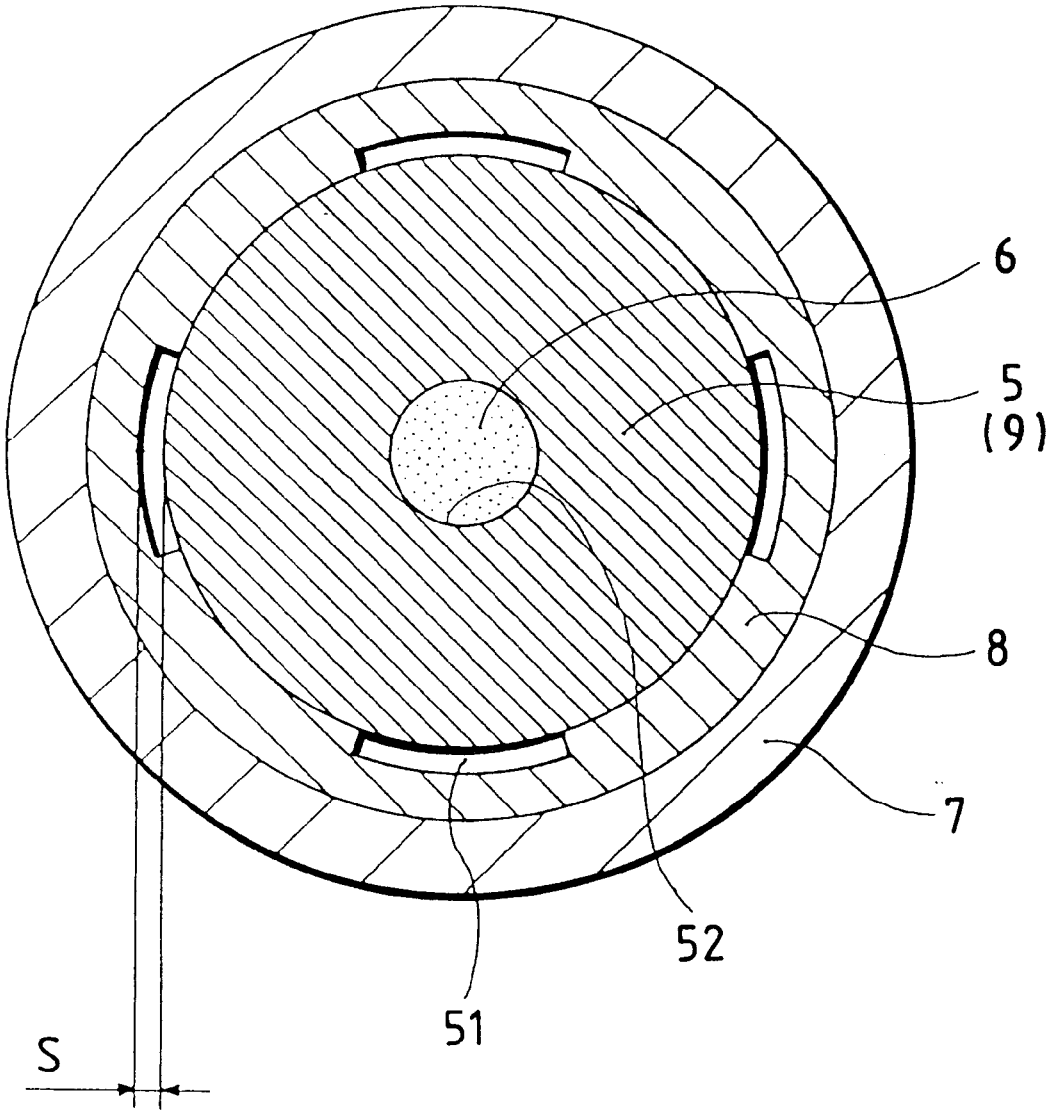
FIG. 10 is an enlarged cross sectional view taken along line D—D shown in FIG. 9.

FIGS. 9 and 10 show a fifth embodiment of the direct ink supply writing implement 1 according to the present invention. The direct ink supply writing implement 1 according to this embodiment has the storage cylinder 8 for accommodating the ink reservoir 4 therein; the barrel 7 having the storage cylinder 8 in the front portion thereof and the ink tank 3 formed in the rear portion thereof through the partition wall 5; and the ink guiding member 6 inserted into the ink reservoir 4 of the barrel 7 in the axial direction, having a rear end allowed to appear in the ink tank 3 and having a front end serving as the nib 2 which outwards projects.

The storage cylinder 8 is a cylindrical member having the front portion which holds the nib 2 and accommodating the ink reservoir 4 therein. The partition wall 5 also serving as the reducing diameter member 9 is secured to the inner surface of the rear end of the storage cylinder 8. The inner diameter of the rear portion of the storage cylinder 8 is reduced.

The ink reservoir 4 made of a material manufactured by melting a synthetic fiber bundle (for example, a fiber bundle made of polyester resin and oriented in the lengthwise direction) is press-fit into the storage cylinder 8 through the opening at the rear end of the storage cylinder 8. At this time, the rear end portion of the ink reservoir 4 is compressed by the front portion 91 of the reducing diameter member 9. Thus, the compressed portion 41 is formed. The ink reservoir 4 has a straight cylindrical shape before it is press-fit into the storage cylinder 8. Thus, the ink reservoir 4 has uniform capillary spaces (that is, uniform capillary force). Therefore, the capillary spaces in the compressed portion 41 at the rear end of the ink reservoir 4 are made densely because of the compression and deformation. Thus, the compressed portion 41 has the capillary force greater than that of the other portions of the ink reservoir 4. The overall inner surface of the central hole 52 and the overall outer surface of the ink guiding member 6 are in contact with each other. The front surface of the partition wall 5 and the rear end (that is, the compressed portion 41) of the ink reservoir 4 are in contact with each other in the axial direction.

The storage cylinder 8 has the tapered front portion which holds the nib 2 such that air flow is permitted. The support rib 81 is provided for the inner surface of the storage cylinder 8 so as to be brought into contact with the front end of the ink reservoir 4. Thus, the foregoing front end is supported so that separation of the ink reservoir 4 is prevented.

The partition wall 5 has a structure that the cylindrical front portion 91 and the flange 93 are integrally formed. A plurality (specifically, four) of axial grooves are formed in the inner surface of the rear end portion of the storage cylinder 8. When the flange 93 of the partition wall 5 is press-fit into the portion in which the grooves are formed, the slit-shape communication hole 51 is formed between the outer surface of the flange 93 and the inner surface of the storage cylinder 8. The communication hole 51 is a circular arc and elongated hole having a horizontal cross sectional shape which has a uniform groove width S. The groove width S (that is, the groove width in the radial direction) is 0.04 mm to 0.07 mm. The central hole 52 is formed to penetrate the axis of the partition wall 5. The rod-shape ink guiding member 6 (for example, a resin material of synthetic resin fiber, such as polyester fiber or acrylic fiber) is inserted into the central hole 52.

In the direct ink supply writing implement 1 according to the fifth embodiment, ink in the ink tank 3 is discharged to the ink reservoir 4 when the internal pressure of the ink tank 3 has been raised. Thus, ink is absorbed by the ink reservoir 4. Discharged ink is continuously stored without existence of air from the compressed portion 41 at the rear end of the ink reservoir 4 to the ink reservoir 4 in front of the compressed portion 41. Therefore, when the pressure in the ink tank 3 has been reduced, return back of ink from the front portion of the ink reservoir 4 to the ink tank 3 can be performed smoothly without any introduction of air.

Sixth Embodiment

Figure 11:
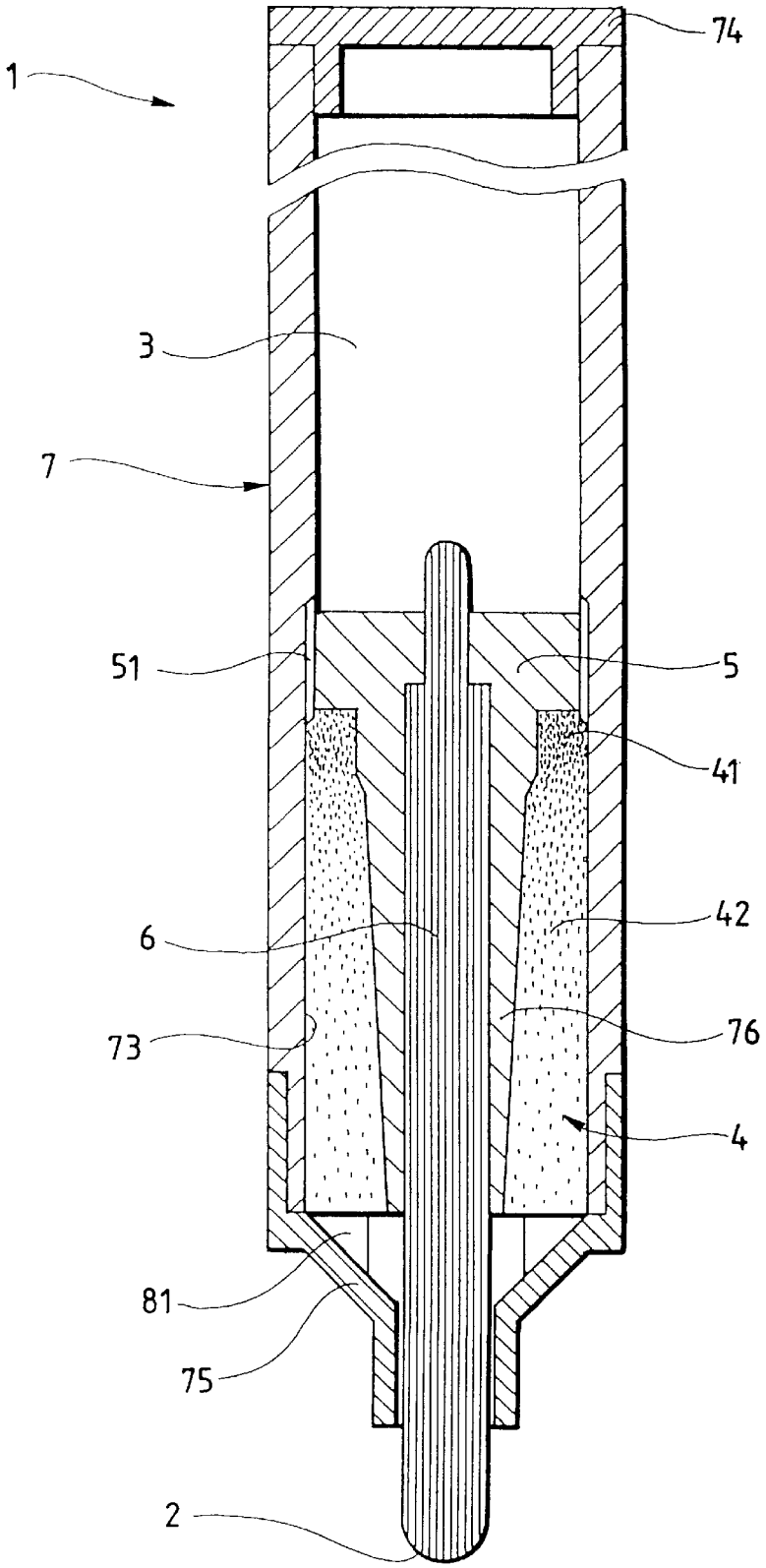
FIG. 11 is a vertical cross sectional view showing a sixth embodiment of the present invention.

FIG. 11 shows a sixth embodiment of the direct ink supply writing implement 1 according to the present invention.

This embodiment is a modification of the fourth embodiment and the fifth embodiment such that the structure of the slit-shape communication hole 51 according to the fifth embodiment is adapted to the structure according to the fourth embodiment. That is, a plurality of axial grooves are formed in the inner surface of the barrel 7. The outer surface of the partition wall 5 is press-fit into the portion in which the foregoing grooves are formed so that the slit-shape communication hole 51 extending in the axial direction and the radial direction is formed between the outer surface of the partition wall 5 and the inner surface of the barrel 7. The other structures are similar to those of the fourth embodiment and the fifth embodiment.

Seventh Embodiment

FIGS. 12 to 16 show a seventh embodiment of the direct ink supply writing implement 1 according to the present invention.

Figure 12:
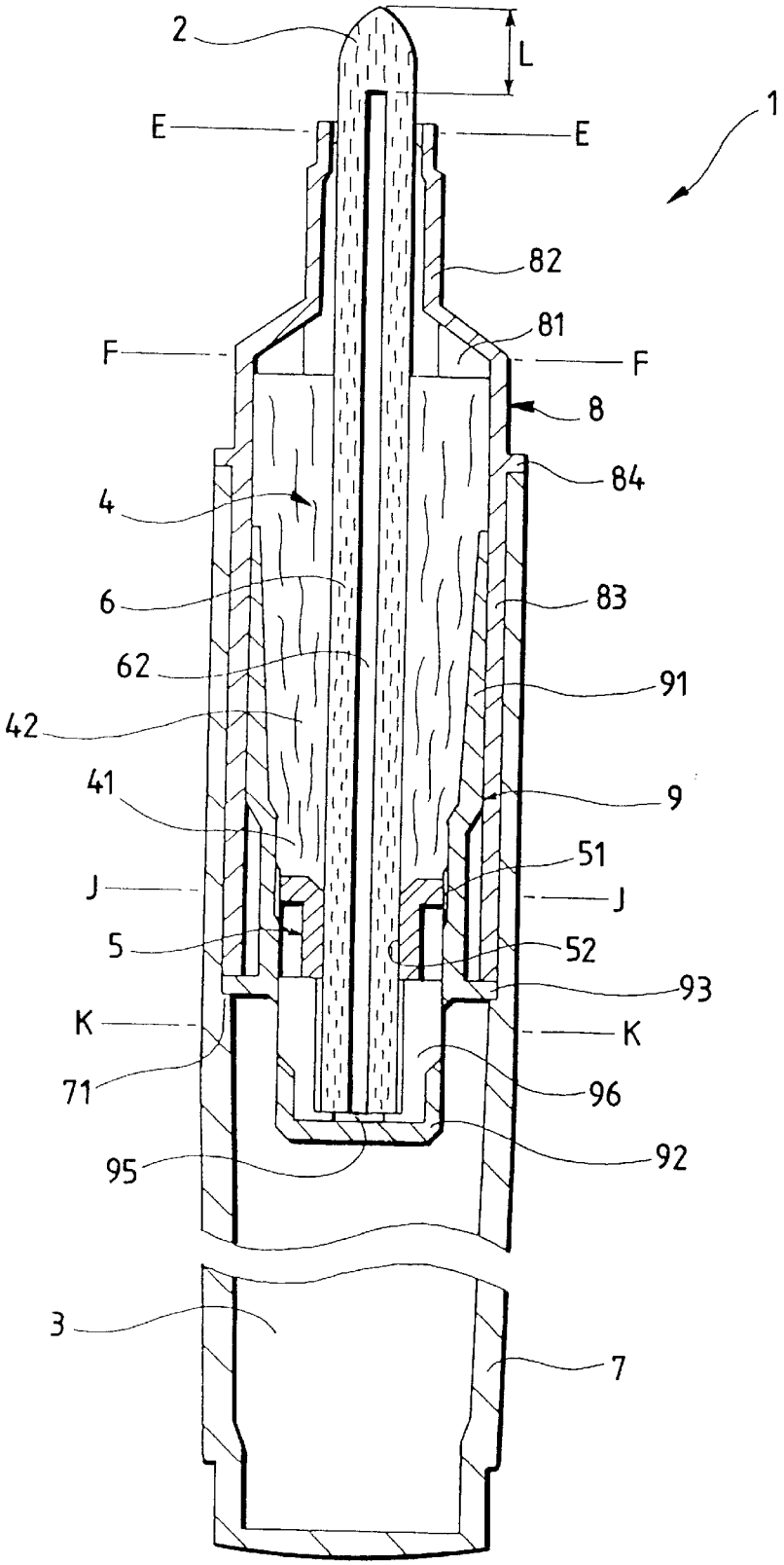
FIG. 12 is a vertical cross sectional view showing a seventh embodiment of the present invention.
Figure 13:
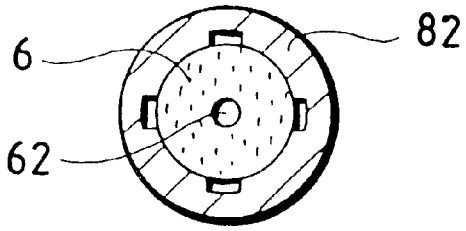
FIG. 13 is an enlarged cross sectional view taken along line E—E shown in FIG. 12.
Figure 14:
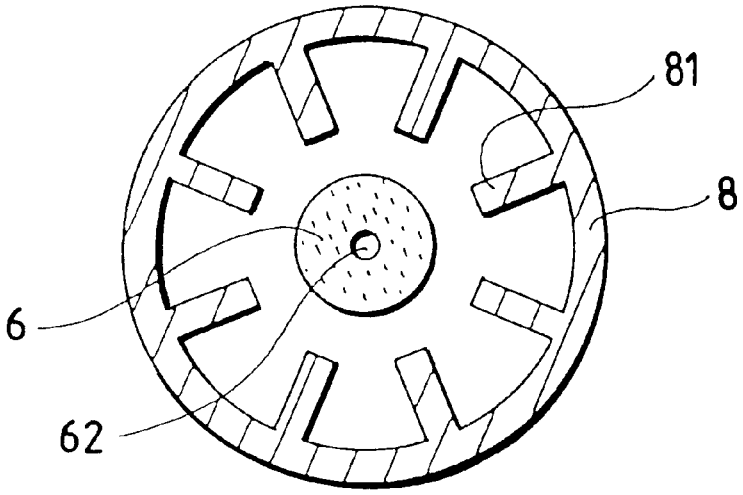
FIG. 14 is an enlarged cross sectional view taken along line F—F shown in FIG. 12.
Figure 15:
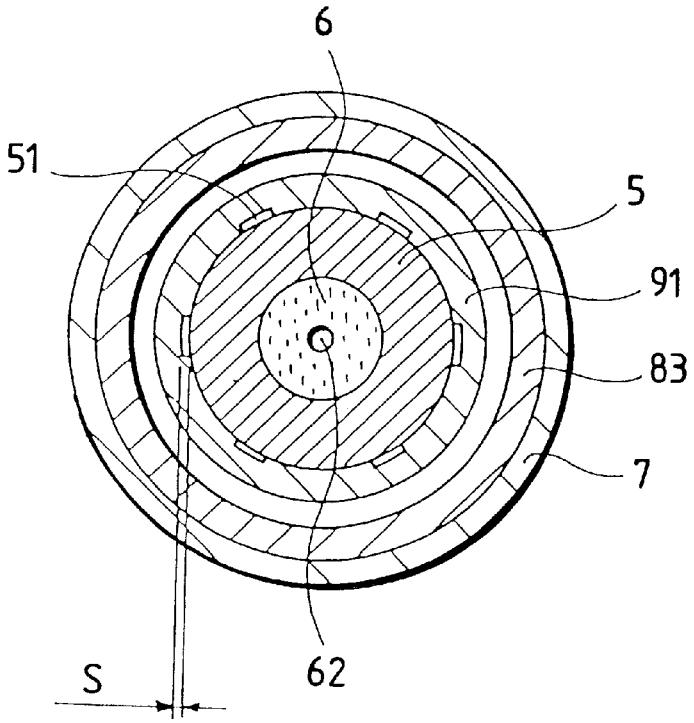
FIG. 15 is an enlarged cross sectional view taken along line J—J shown in FIG. 12.
Figure 16:
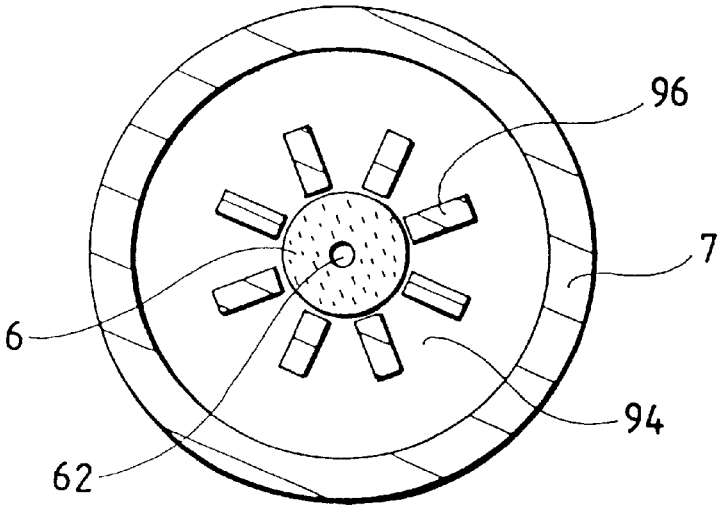
FIG. 16 is an enlarged cross sectional view taken along line K—K shown in FIG. 12.

The direct ink supply writing implement 1 according to this embodiment has the storage cylinder 8 for accommodating the ink reservoir 4 therein; the barrel 7 having the storage cylinder 8 in the front portion thereof and the ink tank 3 formed in the rear of the storage cylinder 8 through the partition wall 5; and the ink guiding member 6 inserted into the ink reservoir 4 of the barrel 7 in the axial direction, having a rear end allowed to appear in the ink tank 3 and having a front end serving as the nib 2 which outwards project. In FIG. 12, the top of the ink discharge passage 62 is projected from the tip end of the tapered portion. However, it may be possible that the top of the ink discharge passage 62 is not projected from the tip end of the tapered portion.

The storage cylinder 8 has a cylindrical shape formed by integrally forming the small-diameter portion 82 and the rear large-diameter portion 83 with each other by molding synthetic resin. The small-diameter portion 82 holds the nib 2, while the large-diameter portion 83 accommodates the ink reservoir 4 therein. Moreover, the outer surface of the large diameter portion 83 is press-fit and secured to the inner surface of the front portion of the barrel 7. A flange portion 84 is provided for the outer surface of the front portion of the large-diameter portion 83, the flange portion 84 being in contact with the edge of the opening of the barrel 7. Moreover, the support rib 81 is provided for the inner surface of the small diameter portion 82 of the storage cylinder 8, the support rib 81 being in contact with the front end of the ink reservoir 4 to support the foregoing front end. Thus, separation of the ink reservoir 4 can be prevented. Moreover, the cylindrical reducing diameter member 9 is press-fit and secured to the inner surface of the rear portion of the storage cylinder 8 so that the inner diameter of the inner surface of the rear portion of the storage cylinder 8 is reduced.

In the storage cylinder 8, the ink reservoir 4 manufactured by melting a synthetic fiber bundle (for example, a fiber bundle made of polyester resin and oriented in the lengthwise direction) is accommodated.

The rear end portion of the ink reservoir 4 is compressed in the radial direction by the reducing diameter member 9 so that the compressed portion 41 is formed. The ink reservoir 4 has a straight cylindrical shape before it is press-fit into the reducing diameter member 9. Thus, the ink reservoir 4 has uniform capillary spaces (that is, uniform capillary force). Therefore, the capillary spaces in the compressed portion 41 at the rear end of the ink reservoir 4 are made densely because of the compression and deformation. Thus, the compressed portion 41 has capillary force greater than that of the other portions (the portions in each of which the capillary spaces are dense) of the ink reservoir 4.

The rod-shape ink guiding member 6 made of a resin material prepared by processing synthetic resin fiber (for example, polyester fiber, acrylic fiber or the like) is joined to the axis of the ink reservoir 4 such that the ink guiding member 6 penetrates the ink reservoir 4 in the axial direction. The outer wall of the ink guiding member 6 is in direct contact with the inner surface of the ink reservoir 4. In particular, the outer surface of the ink guiding member 6 is in strongly contact with the inner surface of the rear end portion of the ink reservoir 4 by the compressed portion 41 formed by inward compression and deformation at the rear end of the ink reservoir 4. As a result, the connection of ink in the ink reservoir 4 and that in the ink guiding member 6 can be stabilized. Moreover, separation of the ink guiding member 6 from the front portion of the barrel 7 can be prevented.

The rear end of the ink guiding member 6 penetrates the ink reservoir 4 and the central hole 52 of the partition wall 5 so as to be allowed to appear in the ink tank 3. The front end of the ink guiding member 6 is processed to have an arbitrary shape which projects forwards and outwards as the nib 2.

The ink discharge passage 62 in the form of a hole having an internal diameter of 1 mm and extending in the axial direction is formed at the axis of the ink guiding member 6. The ink discharge passage 62 is disposed such that the rear end of the ink discharge passage 62 is opened in the ink tank 3 and the front end realizes wall thickness L which is 5 mm from the front end of the nib 2. The capillary force of the ink discharge passage 62 is made to be smaller than that of the outer wall of the ink guiding member 6.

The reducing diameter member 9 incorporates the cylindrical front portion 91 and the cylindrical rear portion 92, the reducing diameter member 9 being manufactured by integrally molding synthetic resin. The cylindrical front portion 91 has the outer surface which is press-fit into the storage cylinder 8 and the inner surface composed of a tapered inner surface having the diameter which is gradually reduced from the front end toward a rear position and a straight inner surface having a diameter which is smaller than that of the rear end of the tapered inner surface. The tapered compressed portion 42 is formed on the outer surface of the compressed portion 41 by the tapered inner surface, while the straight inner surface forms the compressed portion 41 at the rear end of the ink reservoir 4. Thus, the capillary force of the ink reservoir 4 can continuously be enlarged from the front end toward the compressed portion at the rear end.

On the other hand, the cylindrical rear portion 92 of the reducing diameter member 9 projects into the ink tank 3 such that the rear portion 92 has a cylindrical shape having a bottom to surround the rear end of the ink guiding member 6 and its peripheral portion. A small gap for forming the liquid accumulating portion 95 is formed between the bottom surface of the cylindrical rear portion 92 and the rear end surface of the ink guiding member 6 and between the inner surface of the cylindrical rear portion 92 and the outer surface of a portion adjacent to the rear end of the ink guiding member 6. In particular, the gap for forming the liquid accumulating portion 95 has enhanced capillary force to improve the liquid sealing characteristic by reducing the portion adjacent to the opening of the ink discharge passage 62 as compared with the other portions. As a result, if the residual quantity of ink in the ink tank 3 is reduced, ink can temporarily be stored in the liquid accumulating portion 95. Thus, even if the implement for writing is used horizontally or in a state in which the nib is faced upwards, deterioration in the ink discharging characteristic can be prevented.

A plurality of ink guiding ribs 96 radially extending from the axis and extending in the axial direction are integrally formed with the inner surface of the cylindrical rear portion 92. The ink guiding ribs 96 enables ink to quickly be introduced into the liquid accumulating portion 95 from the ink tank 3.

The ink guiding ribs 96 adjacent to the bottom surface of the cylindrical rear portion 92 have a stepped portion to be in contact with the rear end surface of the ink guiding member 6 so as to support the rear end surface in such a manner that the opened state of an ink introduce passage 63 is maintained. A small gap having capillary force is formed between the bottom surface of the cylindrical rear portion 92 and the rear end surface of the ink guiding member 6 so that the rear end opening of the ink introduce passage 62 is liquid-sealed.

The opening 94 communicated with the ink guiding ribs 96 is formed in the side wall of the cylindrical rear portion 92. As a result, the ink tank 3 and the ink guiding ribs 96 are connected to each other. Thus, the ink tank 3 and the rear end of the ink guiding member 6 are communicated with each other through the ink guiding ribs 96. Moreover, the ink tank 3 and the rear surface of the partition wall 5 are communicated with each other.

Since the ink guiding ribs 96 are formed radially, the intervals among the ink guiding ribs 96 are gradually reduced in a direction from a radially outer portion toward the inner portion, that is, toward the ink guiding member 6 at the axis. Thus, the capillary force is enlarged toward the ink guiding member 6 at the axis. As a result, the function for quickly introducing ink from the ink tank 3 to the ink guiding member 6 can furthermore be enhanced.

The flange 93 is continuously formed between the cylindrical front portion 91 and the cylindrical rear portion 92. The flange 93 is, in the axial direction, held between the rear end of the storage cylinder 8 and the stepped portion 71 on the inner surface of the barrel 7.

The partition wall 5 incorporates the disc shape flange and the cylindrical portion continuously formed in the rear of the flange, the partition wall 5 being formed into a member (a non-porous member) manufactured by integrally molding synthetic resin. The partition wall 5 is press-fit and secured to the inner portion of the reducing diameter member 9. A plurality (specifically, eight) of axial grooves are formed in the inner surface of the reducing diameter member 9. When the flange of the partition wall 5 is press-fit into the portion having the grooves in the inner surface of the reducing diameter member 9, the axially penetrating slit-shape communication hole 51 is formed between the outer surface of the flange of the partition wall 5 and the inner surface of the reducing diameter member 9. The communication hole 51 is a circular arc shape or a rectangular slit having a horizontal cross sectional shape which has a uniform groove width and extending in the circumferential direction. The gap size (that is, groove width S in the radial direction) is 0.04 mm to 0.07 mm. Since the communication hole 51 is formed between the outer surface of the flange of the partition wall 5 and the inner surface of the reducing diameter member 9, the groove width S can reliably and easily be set even if the groove width S of the communication hole 51 is relatively small.

The central hole 52 penetrating the axis of the cylindrical portion of the partition wall 5 is formed. The ink guiding member 6 is inserted into the central hole 52. The overall inner surface of the central hole 52 and the overall outer surface of the ink guiding member 6 are in closely in contact with each other. The front surface of the partition wall 5 is in contact with the rear end (the compressed portion 41) of the ink reservoir 4.

Eighth Embodiment

Figure 17:
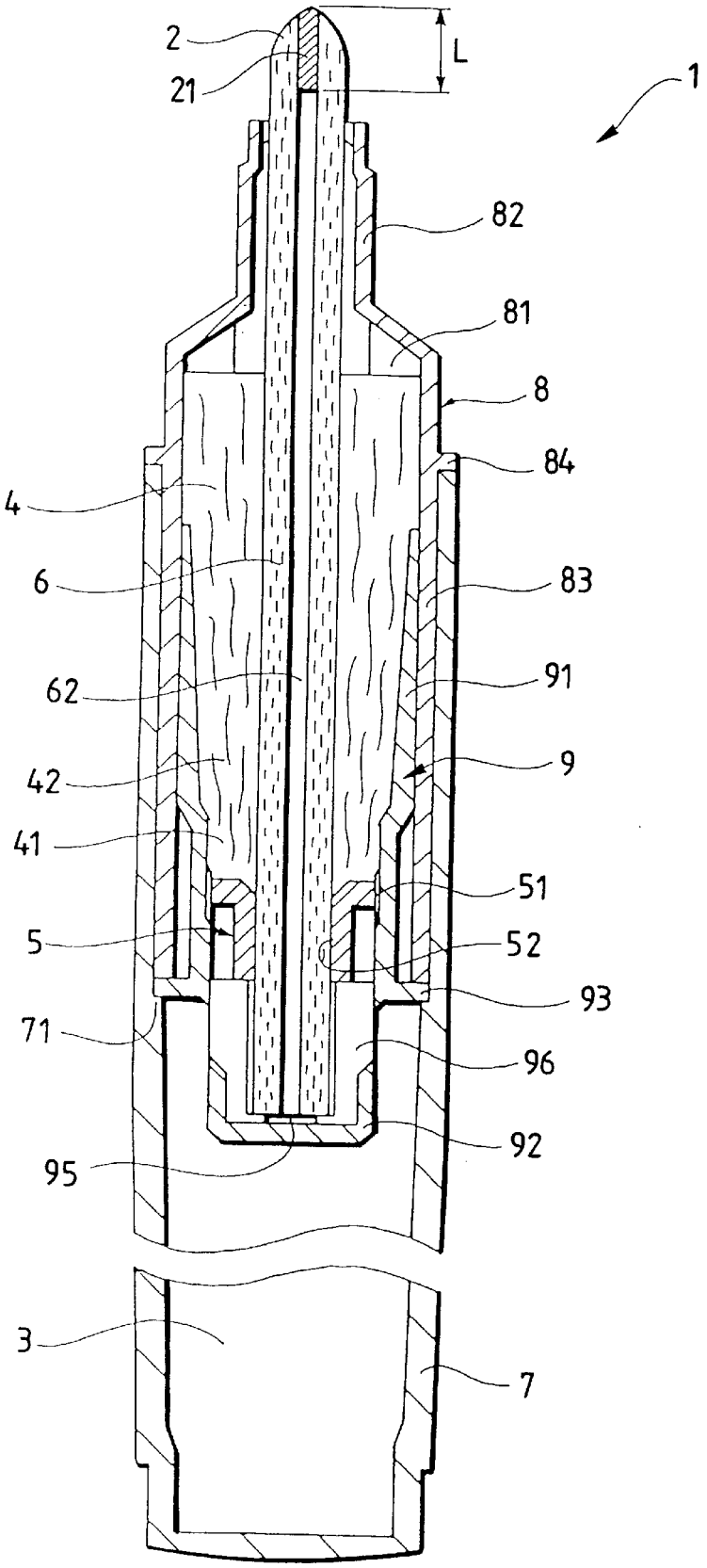
FIG. 17 is a vertical cross sectional view of an eighth embodiment of the present invention.

FIG. 17 shows an eighth embodiment of the direct ink supply writing implement 1 according to the present invention. This embodiment is a modification of the ink guiding member 6 according to the seventh embodiment. The front end of the tubular ink guiding member 6 made of a porous material (for example, a member manufactured by processing resin fiber) having a through hole having an internal diameter of 1 mm at the axis thereof is closed by inserting and securing an individual cap 21 (specifically, a synthetic resin pin) to the front end of the through hole. Moreover, the foregoing portion is formed into the nib by a cutting work or the like. The other structures are similar to those according to the seventh embodiment.

Ninth Embodiment

Figure 18:
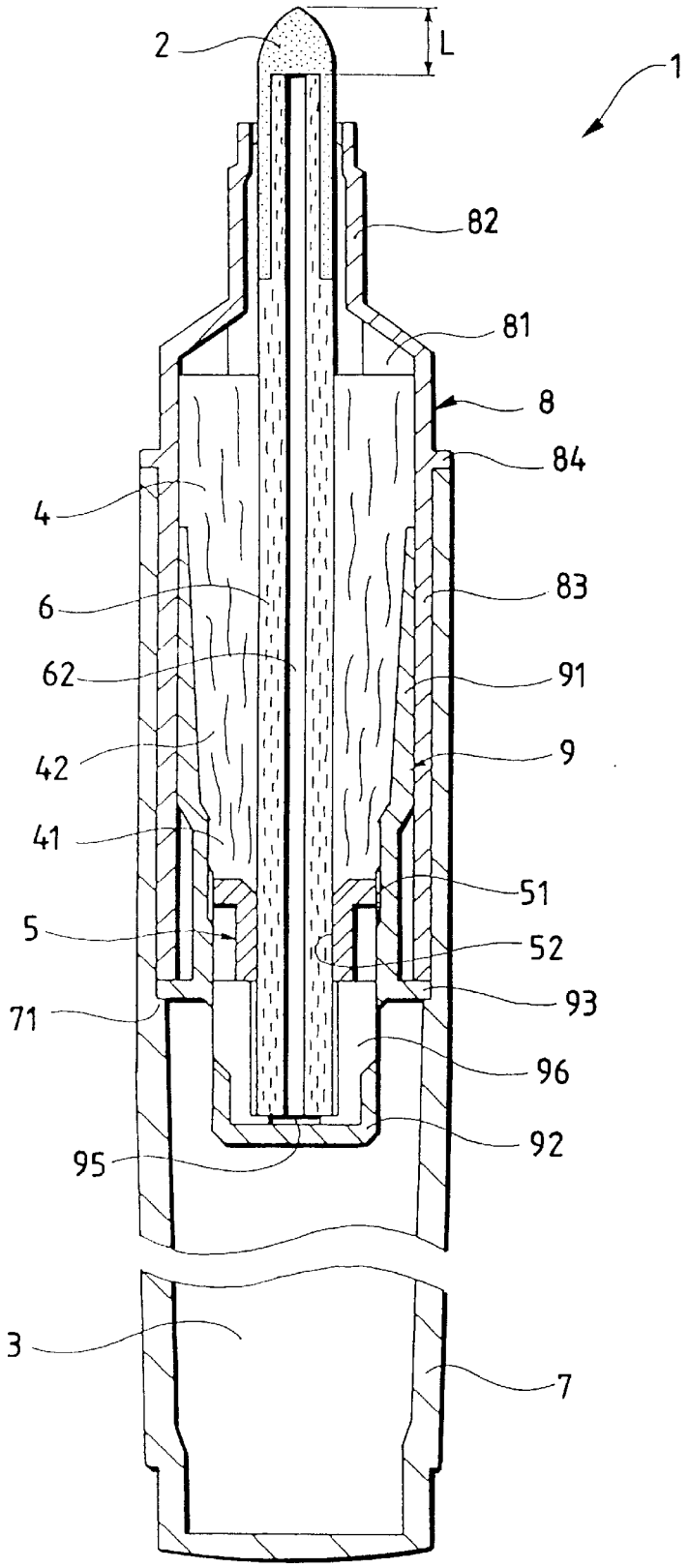
FIG. 18 is a vertical cross sectional view of a ninth embodiment of the present invention.

FIG. 18 shows a ninth embodiment of the direct ink supply writing implement according to the present invention.

This embodiment is a modification of the ink guiding member 6 according to the seventh embodiment in which the nib 2 made of a porous material (for example, a synthetic resin open cell) is secured to the outer surface of the front end of the tubular ink guiding member 6 made of a porous material (for example, a member manufactured by processing resin fiber) having a through hole having an internal diameter of 1 mm at the axis thereof. The other structures are similar to those according to the seventh embodiment.

Tenth Embodiment

Figure 19:
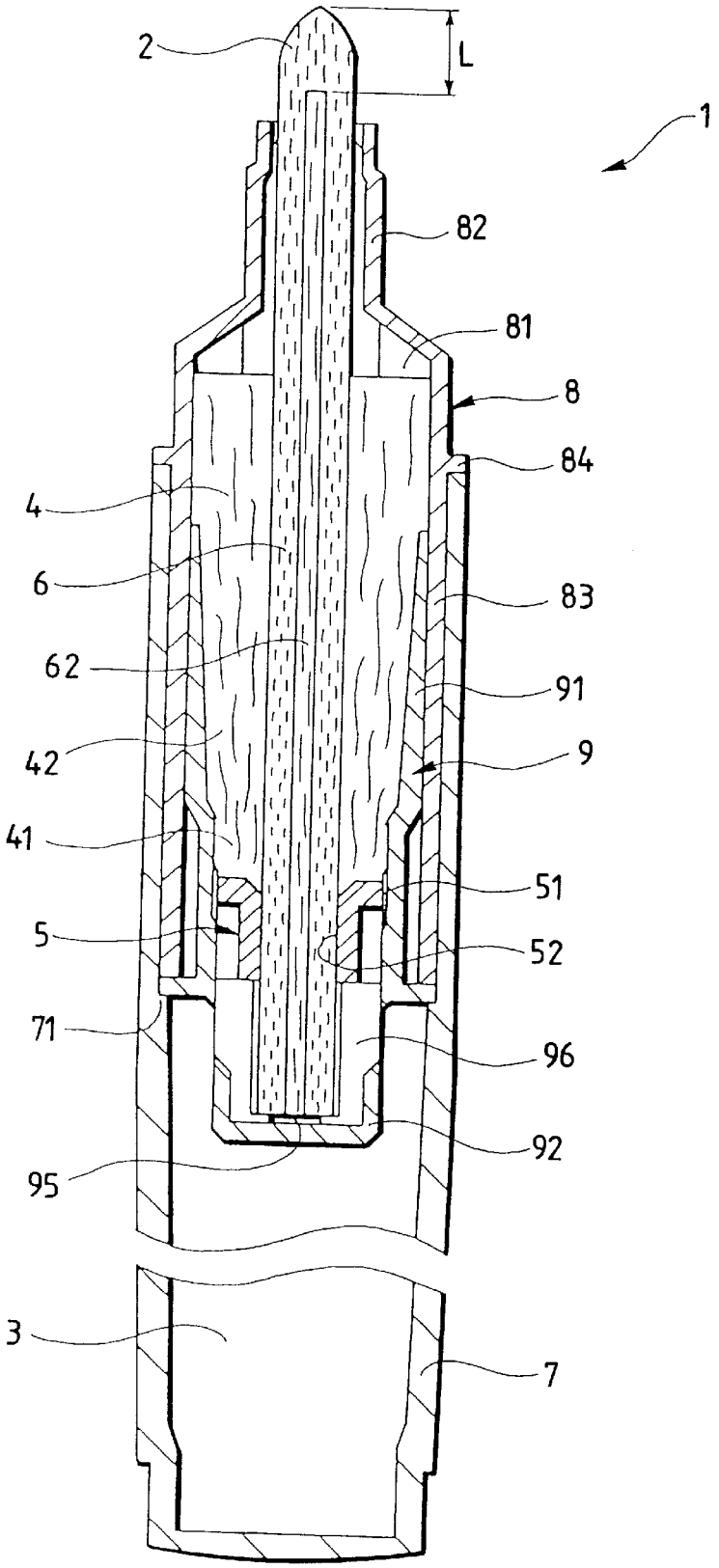
FIG. 19 is a vertical cross sectional view showing a tenth embodiment of the present invention.

FIG. 19 shows a tenth embodiment of the direct ink supply writing implement 1 according to the present invention. This embodiment is a modification of the ink guiding member 6 according to the seventh embodiment. The structure of the ink discharge passage 62 in the ink guiding member 6 is arranged such that a rod member made of a porous material is received in a hole formed at the axis of the ink guiding member 6. The rod member is an individual member (for example, a member manufactured by processing resin fiber) having capillary force smaller than that of the outer wall of the ink guiding member 6. The other structures are similar to those according to the seventh embodiment.

Ink Reservoir

As an alternative to the member manufactured by thermal melting the fiber bundle or resin according to the first to tenth embodiments, the ink reservoir made of the porous material of the direct ink supply writing implement 1 according to the present invention may be any one of a member manufactured by processing felt resin, a member manufactured by thermally melting felt, a member manufactured by needle-punching felt, an open cell of synthetic resin, such as sponge, an open cell of a metal material and an open cell of ceramic.

Nib

The nib 2 of the direct ink supply writing implement 1 according to the present invention is required to be a member which can be connected to the ink guiding member 6 such that ink flow is permitted and which is able to discharge ink supplied from the ink guiding member 6 to the surface of paper or the like. As an alternative to the porous material according to the first to tenth embodiments (for example, the porous materials such as the member manufactured by thermally processing a resin fiber bundle, processed felt, an open cell of synthetic resin, an open cell of a metal material or an open cell of ceramic), a member manufactured by extruding synthetic resin, a chip of a ball pen, a pen member of a fountain pen type or a pipe-like pen member may be employed.

To furthermore enhance the ink discharging characteristic, it is preferable that the capillary force of the nib 2 is similar to that of the outer wall of the ink guiding member 6 or greater than the same.

Ink Tank

The ink tank 3 of the direct ink supply writing implement 1 according to the present invention is required to be connected to the compressed portion 41 of the ink reservoir 4 such that ink flow is permitted. Specifically, any one of the following structures may be employed: a structure which is integrally formed with the cylindrical member for accommodating the ink reservoir 4 (for example, the barrel 7, the storage cylinder 8, the partition wall 5, the reducing diameter member 9 or the like) and a structure formed by joining an individual member which is joined to the cylindrical member or the like. Another structure may be employed in which is ink supply is permitted through the rear end opening of the ink tank 3.

Ink Guiding Member

As an alternative to the member manufactured by processing the resin fiber bundle or the member manufactured by thermally melting the fiber bundle, the ink guiding member 6 of the direct ink supply writing implement 1 according to the present invention may be a synthetic resin member having, on the outer surface thereof or an inner surface thereof, an ink discharging groove and manufactured by an extruding process or an injection molding process or an open cell of synthetic resin, such as sponge. To sufficiently and smoothly supply ink to the nib 2, the capillary force of the ink guiding member 6 is at least larger than that of the compressed portion 41 of the ink reservoir 4 and that of the communication hole 51.

Partition Wall

The partition wall 5 of the direct ink supply writing implement 1 according to the present invention may be formed integrally with the ink tank 3 and the barrel 7. The partition wall 5 may be an individual member from the ink tank 3 and the barrel 7.

What is claimed is:

1. A direct ink supply writing implement comprising:

an ink reservoir made of a porous material disposed between a nib and an ink tank;

a partition wall disposed between said ink reservoir and said ink tank and arranged to partition said ink reservoir and said ink tank from each other;

a communication hole formed in said partition wall for establishing communication between said ink reservoir and said ink tank;

a rod-shape ink guiding member which penetrates said partition wall and with which ink is supplied from said ink tank to said nib ; and a compressed portion formed at a rear end of said ink reservoir and arranged to enhance capillary force as compared with other portions.

2. A direct ink supply writing implement according to claim 1, wherein said compressed portion is formed by inwards compressing an outer surface of a rear end of said ink reservoir in a radial direction, and an inner surface of said compressed portion and an outer surface of said ink guiding member are in close contact with each other.

3. A direct ink supply writing implement according to claim 2, wherein a tapered compressed portion having a diameter which is gradually reduced in a direction from a front portion thereof to a rear portion of the same is provided for an outer surface of said ink reservoir, a straight compressed portion having a diameter smaller than that of said tapered-compressed portion is provided for a rear end of said tapered compressed portion so that capillary force of said ink reservoir is gradually enlarged in a direction from a front portion thereof to a rear end of the same.

4. A direct ink supply writing implement according to claim 3, wherein capillary force T at an arbitrary position in said ink reservoir is made to be larger than nib water head G at a height H from said nib to said arbitrary position, and difference between said capillary force T and said nib water head G is gradually enlarged in a direction from a front end of said ink reservoir to a rear end of said ink reservoir.

5. A direct ink supply writing implement according to claim 1, wherein said communication hole is formed into a slit shape extending in an axial direction.

6. A direct ink supply writing implement according to claim 5, wherein width S of said communication hole is 0.02 mm to 0.25 mm.

7. A direct ink supply writing implement according to claim 6, wherein an outer surface of said partition wall is press-fit into an inner surface of said barrel, and said slit-shape communication hole extending in an axial direction and in a circumferential direction is formed between an inner surface of said barrel and an outer surface of said partition wall.

8. A direct ink supply writing implement according to claim 1, wherein a straight compressed portion is formed by outwards compressing an inner surface of a rear end of said ink reservoir in a radial direction.

9. A direct ink supply writing implement according to claim 8, wherein a tapered compressed portion having a diameter which is gradually enlarged in a direction from a front portion thereof to a rear portion thereof is provided for an inner surface of said ink reservoir and a straight compressed portion having a diameter larger than that of said tapered compressed portion is provided for a rear end of said tapered compressed portion so that capillary force of said tapered compressed portion is gradually enlarged in a direction from a leading end thereof to a rear end thereof.

10. A direct ink supply writing implement according to claim 1, wherein a rear end and straight compressed portion and a front surface of said partition wall are in contact with each other.

11. A direct ink supply writing implement according to claim 1, wherein said ink reservoir is made of processed fiber.

12. A direct ink supply writing implement according to claim 1, wherein said ink guiding member is a porous member.

13. A direct ink supply writing implement according to claim 12, wherein an ink discharge passage is provided for an inside portion of said ink guiding member, said ink discharge passage having a leading end disposed adjacently to a portion adjacent to a leading end of said nib and a rear end which is opened in said ink tank.

14. A direct ink supply writing implement according to claim 13, wherein capillary force of an outer wall of said ink guiding member is made to be larger than capillary force of said ink reservoir and capillary force of said ink discharge passage.

15. A direct ink supply writing implement according to claim 14, wherein a liquid accumulating portion for liquid-sealing an opening of a rear end of said ink discharge passage is provided for a rear end of said ink guiding member.

16. A direct ink supply writing implement according to claim 13, wherein a nib made of a porous material is provided for a leading end of said ink guiding member and length L of a wall from a leading end of said ink discharge passage to a leading end of said nib is made to be 1 mm to 20 mm.

* * * * *